US006481820B1

(12) United States Patent
Tamura et al.

(10) Patent No.: US 6,481,820 B1
(45) Date of Patent: Nov. 19, 2002

(54) INK JET PRINTER WHICH CAN CARRY OUT HIGH SPEED IMAGE FORMATION AND WHICH CAN AVOID IMAGE FAILURE DUE TO A DEFECTIVE NOZZLE

(75) Inventors: Akihiko Tamura; Takuo Nishikawa, both of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/314,347

(22) Filed: May 19, 1999

(30) Foreign Application Priority Data

May 25, 1998 (JP) ..... 10-142958
Jun. 29, 1998 (JP) ..... 10-182032

(51) Int. Cl.[7] ..... B41J 29/393
(52) U.S. Cl. ..... 347/19
(58) Field of Search ..... 347/19, 43, 13, 347/35, 85, 171, 14, 5, 9, 12, 57, 42, 50, 58, 59, 180, 181, 182

(56) References Cited

U.S. PATENT DOCUMENTS

| | | | |
|---|---|---|---|
| 5,371,531 | A | 12/1994 | Rezanka et al. |
| 5,398,053 | A | 3/1995 | Hirosawa et al. |
| 5,587,730 | A | 12/1996 | Karz |
| 5,600,354 | A | 2/1997 | Hackleman et al. |
| 5,602,624 | A | 2/1997 | Coburn et al. |

FOREIGN PATENT DOCUMENTS

| | | |
|---|---|---|
| EP | 0 372 895 A | 6/1990 |
| EP | 0 640 479 A | 3/1995 |
| EP | 0 646 460 A | 4/1995 |
| EP | 0 693 380 A | 1/1996 |
| EP | 0 778 151 A | 6/1997 |
| EP | 0 835 761 A | 4/1998 |
| JP | 62-161547 | 7/1987 |
| WO | 97/31781 | 9/1997 |

OTHER PUBLICATIONS

Patent Abstracts of Japan, vol. 018, No. 154 (M–1577), Mar. 15, 1994, Abstract of JP 05 330037 A, Dec. 14, 1993.

*Primary Examiner*—Raquel Yvette Gordon
(74) *Attorney, Agent, or Firm*—Frishauf, Holtz, Goodman & Chick, P.C.

(57) ABSTRACT

An ink-jet printer which can carry out high speed image formation and which can avoid image failure due to a defective nozzle includes a first printing head to emit ink particles, said first printing head being a line-type head in which a plurality of ink-jet nozzles are arranged in a line, and a second printing head to emit ink particles having a same color as that of the ink particles emitted by the first printing head. Alternatively, the ink-jet printer may include a printing head to emit ink particles, a nozzle checking device for detecting a defect of the ink-jet nozzle mounted in the printing head, and a driving unit for moving the printing head in a line direction.

2 Claims, 20 Drawing Sheets

INK JET PRINTER WHICH CAN CARRY OUT HIGH SPEED IMAGE FORMATION AND WHICH CAN AVOID IMAGE FAILURE DUE TO A DEFECTIVE NOZZLE

BACKGROUND OF THE INVENTION

The present invention relates to a line type ink-jet printer which has a line-type head in which a plurality of nozzles are arranged, whose length is corresponding to the width of the recording medium, and in which ink is jetted from the nozzles onto the recording medium, and the recording medium is conveyed in a subsidiary scanning direction to thereby from an image is formed on the recording medium. More particularly, the present invention relates to an ink-jet printer suitable for high speed image formation and image formation with high resolution.

The image formation in the ink-jet printer is carried out as follows: the head is moved in the primary scanning direction while droplets of ink which are jet-controlled by an image signal, are jetted from nozzles of the head onto the recording medium; when the image is recorded on the recording medium by one line, the recording medium is moved in the subsidiary scanning direction by one line; the droplets of ink are jetted again from nozzles of the head onto the recording medium and one line of image is formed; and hereinafter, by repeating these operations, an image is formed on the recording medium.

Alternatively, as another structure, as disclosed in Japanese Tokkaisho No. 62-161547, there is a structure in which ink nozzles of the head are arranged with an equal pitch in the length of almost maximum recording width of the recording medium, and the head is structured as a fixed linetype head.

According to the structure, movement of the head in the primary scanning direction is not necessary, and an image can be formed only by the conveyance of the recording medium in the subsidiary scanning direction which is perpendicular to the primary scanning direction, thereby, high speed image formation can be carried out.

As described above, in the ink-jet printer having a fixed line-type head in which the head is not moved in the primary scanning direction, for example, when there are such nozzle defects as in the cases in which nozzles are blocked by dusts or the like, and ink can not be jetted (hereinafter, called no-jetting of ink), or the peripheral portion of a jetting port of the nozzle is wetted by ink, a liquid drop of the jetted ink is attracted to the wetted portion, and the ink is not recorded on the target position on the recording medium (hereinafter, called curved-shooting of ink), image failure is generated in the image formed on the recording medium.

In more detail, in the case of no-jetting of ink, a longitudinal streak is formed on the recording medium in the subsidiary scanning direction. Further, in the case of the curved-shooting of ink, as shown in FIG. 12, when the jetted ink C from the nozzle c causes the curved-shooting of ink due to wetting of ink on the periphery of the nozzle and forms a line C—C, the line C—C formed by dots of the jetted ink approaches a line B—B formed in the same manner, and simultaneously, is apart from a line D—D, and a pitch between lines with respect to other lines A—A and E—E is different, and a longitudinal stripe is formed as the image formed by dots of ink in the subsidiary scanning direction.

When such the image failure due to a defect of the nozzle occurs, the image failure can not be solved if the head is not replaced.

FIG. 20 is a view showing an example of a line type ink-jet printer having the conventional line-type head.

In the line type ink-jet printer 1, the recording sheet P is nipped by conveyance roller pairs 31 and 32, and is further conveyed in the direction Y in the drawing, by the roller pair 31 driven by a conveyance motor 33.

A line-type head 2 is provided in opposite to the surface PS of the recording sheet P as the recording medium between conveyance roller pairs 31 and 32. The line-type head 2 is connected to a control substrate 51 on which the control section is provided, through a flexible cable 4 (hereinafter called FPC).

Next, referring to FIG. 2, the line-type head will be described.

As shown in the drawing, the line-type head 2 can be separated into a base substrate 24 and a cover substrate 25. Piezoelectric elements 22 are arranged in a line on the base substrate 24, and each piezoelectric element 22 is connected to the FPC 4 through a circuit lead 23.

Nozzles 21, each of which form a pair with each piezoelectric element 22, are aligned on the cover substrate 25 in a line with the same pitch, each nozzle 21 is connected to a fine tube provided with a portion to receive ink-jet-pressure by the piezoelectric element 22, and the fine tube is connected to an ink tank provided in the cover substrate 25.

Next, operations of the above-described structure will be described. A control section on the control substrate 51 makes a conveyance mechanism 3 convey the recording sheet P at a predetermined speed, drives the piezoelectric element 22 according to an image signal, jets liquid drops of ink simultaneously for each line from the nozzles 21 of the line-type head 2, and forms an image on the recording sheet P.

As compared to a so-called shuttle type ink-jet printer whose head is driven in the primary scanning direction, the line type ink-jet printer with the above-described structure does not need the movement of the head in the primary scanning direction, and can form an image only by the conveyance of the recording sheet P in the subsidiary scanning direction which is perpendicular to the primary scanning direction, thereby, the line type ink-jet printer can conduct high speed image formation.

However, in such the line type ink-jet printer having only one line-type head 2, for example, when there are such defects of the nozzle 21 as in the cases in which the nozzles 21 of the line-type head 2 are blocked by dusts or the like, and ink can not be jetted (hereinafter, called no-jetting of ink), or the peripheral portion of a jetting port of the nozzle 21 is wetted by ink, a liquid drop of the jetted ink is attracted to the wetted portion, and the ink is not recorded on the target position on the recording medium (hereinafter, called curved-shooting of ink), an image failure (noise) occurs in the image formed on the recording sheet P, which is a problem.

Further, it is necessary to provide piezoelectric elements 22, ink tanks, fine tubes, etc., in the line-type head 2 corresponding to each nozzle 21, therefore, there is a limit to make a pitch of the nozzle 21 closer, thereby, an image with high resolution can not be obtained, which is also a problem.

In this case, when the line-type head 2 is slantingly arranged to the primary scanning direction, a pitch of the nozzle in the primary scanning direction is made closer, and the resolution can be increased, however, the distance to move the recording sheet P in the subsidiary scanning direction is increased, and image forming speed is lowered, which is another problem.

Further, the ink-jet head has a proper driving frequency, without depending on its type such as the type using piezoelectric elements, the high voltage system, the bubble-burst type, etc.

Accordingly, there is such a problem that the image forming speed is also determined by the driving frequency of the head.

Further, when a line-type head is produced, in the present, cost is increased for the production of the line-type head longer than 5 inches, accordingly, a plurality of short line-type heads are jointed and one longer line-type head is produced.

On the other hand, in the line-type head, liquid drop jetting characteristics of both end nozzles which are affected by only one side nozzle, and liquid drop jetting characteristics of nozzles except both ends which are affected by both side nozzles, are different from each other.

Accordingly, in the line-type head produced by jointing short line-type heads, nozzles having different liquid drop jetting characteristics exist in one line, there is also a problem that image failure occurs on the recording sheet P.

Further, when the line-type head is produced by jointing short line-type heads, it is difficult to correctly adjust nozzle pitches at joint portions, accordingly, this is also a problem to cause image failure on the recording sheet P.

SUMMARY OF THE INVENTION

The present invention is achieved in view of the foregoing problems.

The first object of the present invention is to provide an ink-jet printer by which high speed image formation can be carried out.

The second object of the present invention is to provide a line type ink-jet printer in which image failure due to a defective nozzle can be improved.

The third object of the present invention is to provide a line type ink-jet printer in which the frequency of replacement of a line-type head is reduced, replacement cost is reduced, and an increase of reliability can be attained.

The fourth object of the present invention is to provide an ink-jet printer by which image formation with high image quality can be carried out.

To overcome the cited shortcomings, the abovementioned objects of the present invention can be attained by an ink-jet printer described as follow:

(1) An ink-jet printer, comprising:

a first printing head to emit ink particles, being a line-type head in which a plurality of ink-jet nozzles are arranged in a line; and a second printing head to emit ink particles having a color same as that of the ink particles emitted by the first printing head.

(2) An ink-jet printer, comprising:

a printing head to emit ink particles, being a line-type head in which a plurality of ink-jet nozzles are arranged in a line;

a nozzle checking means for detecting a defect of the ink-jet nozzle mounted in the printing head; and a driving means for moving the printing head in a direction of the line, wherein the ink-jet printer performs a plurality of scanning operations onto a same scanning line of the recording medium to form an image of the scanning line when the nozzle checking means detects the defect, in such a manner that, in at least one scanning of the plurality of scanning operations, the driving means moves the printing head in a direction of the line so as to form the image of the scanning line by using another normal ink-jet nozzle instead of a defective ink-jet nozzle detected by the nozzle checking means.

Further, in order to solve the above-described problems and to attain the abovementioned objects, the following features of an ink-jet printer are desirable embodiments of the present invention.

(1) A line-type ink-jet printer which comprises, a line-type head in which a plurality of ink-jet nozzles are arranged in a width direction substantially the same length as that of a recording medium, to emit ink particles from the ink-jet nozzles onto the recording medium, wherein the line-type ink-jet printer forms an image on the recording medium by conveying the recording medium in a subsidiary scanning direction, and further comprises, a nozzle checking means for detecting a defect of said ink-jet nozzle included in said first printing head;

a auxiliary head arranged in parallel with the line-type head; and a control means for conducting image formation by means of the auxiliary head when a defect of the ink-jet nozzles included in the line-type head is detected by information incoming from the nozzle checking means.

As described above, when there is any defect on the line-type head, image failure due to nozzle defect can be improved by conducting image formation by using an auxiliary head provided in parallel to the line-type head.

Herein, when a head having image recording width more than that of the line-type head is used as an example of an auxiliary head, image failure can be improved by using the auxiliary head instead of the line-type head, or by driving a nozzle of the auxiliary head corresponding to the defective nozzle of the line-type head.

Particularly, when a nozzle of the auxiliary head is driven corresponding to the defective nozzle of the line-type head, frequency of the replacement of the line-type head is decreased, resulting in a decrease of the replacement cost, and an increase of the reliability.

Further, when, as the auxiliary head, a head movable in the line direction of the line-type head is used, the auxiliary head is moved in such a manner that a nozzle of the auxiliary head is located at a position corresponding to the defective nozzle of the line-type head, the nozzle of the auxiliary head is used instead of the defective nozzle of the line-type head, and an image is formed, thereby, image failure is improved and frequency of replacement of the line-type head is reduced, resulting in a reduction of replacement cost and an increase of the reliability.

(2) A line-type ink-jet printer which comprises, a line-type head in which a plurality of ink-jet nozzles are arranged in a width direction substantially the same length as that of a recording medium, to emit ink particles from the ink-jet nozzles onto the recording medium, wherein the line-type ink-jet printer forms an image on the recording medium by conveying the recording medium in a subsidiary scanning direction, and further comprises, a nozzle checking means for detecting a defect of said ink-jet nozzle included in said first printing head;

a driving means for moving the line-type head in the line direction, wherein said ink-jet printer performs a plurality of scanning operations onto a same scanning line of the recording medium to form an image of the scanning line when a defect of the ink-jet nozzles included in the line-type head is detected by information incoming from the nozzle checking means, in such a manner that, in at least one scanning of the plurality of scanning operations, the driving means moves the line-type head in the line direction so as to form the image of the scanning line by using another normal ink-jet nozzle instead of a defective ink-jet nozzle detected by the nozzle checking means.

In the plurality of image formation conducted on the same recording medium, at least one image formation is conducted by moving the line-type head in the line direction of the line-type head, and image formation of the defective portion is conducted by using other normal nozzles, thereby, image failure due to the defect of the nozzle can be improved.

Further, frequency of replacement of the line-type head is reduced, resulting in a reduction of replacement cost and an increase of the reliability.

Incidentally, from a view point of the mechanical simplicity, it is desirable that the drum, rotated around its center axis, conveys said recording medium in a subsidiary scanning direction by bearing the recording medium on its circumferential surface.

(3) An ink-jet printer, in which a plurality of line-type heads, each of which emit ink particles having a same color each other onto a recording medium, are arranged.

A plurality of line-type heads by which liquid drops of ink of the same color are jetted on the recording medium, are provided, thereby, image formation with high image quality or high speed image formation can be attained.

(4) The ink-jet printer of item (3), in which, between adjacent nozzles of one line-type head of the plurality of heads, nozzles of the other line-type heads are located.

In the primary scanning direction, when, between adjacent nozzles of one line-type head of the plurality of heads, nozzles of the other line-type heads are located, resolution in the primary scanning direction is improved, and a high quality image can be formed.

Further, even if there is a nozzle defect such as no-jetting of ink or curved-shooting of ink, in any line-type heads of a plurality of line-type heads, and noise is generated in an image, the noise is reduced by image formation by using other line-type heads, and high image quality is attained.

For example, when an arrangement pitch of nozzles in a primary scanning direction of each line-type head and a number of the line-type heads are defined as P(dpi) and N, respectively, the resolution of the formed image is resulted in P×N (dpi) by shifting an arrangement of nozzles of each line-type head at P/N(dpi) in a primary scanning direction. Thus the resolution is improved and high image quality is attained.

(5) The ink-jet printer of item (3), in which a plurality of line-type heads are arranged in a direction so that each line of the line-type heads crosses the primary scanning direction.

When a plurality of line-type heads are located in the direction to cross the primary scanning direction, nozzle pitches in the primary scanning direction are decreased, resolution is increased, and image formation with high quality can be attained.

Further, by providing a plurality of line-type heads, the movement distance of the recording sheet in the subsidiary scanning direction is decreased, and the image forming speed is not lowered.

(6) The ink-jet printer of item (3), in which each of nozzles of the plurality of line-type heads is located at the same position in the primary scanning direction.

When each of nozzles of the plurality of line-type heads is located at the same position in the primary scanning direction, a plurality of line images can be simultaneously formed, thereby, high speed image formation can be attained.

Further, when the relative movement in the subsidiary scanning direction of the recording sheet to line-type heads is made into such a movement that a band image obtained by one image formation by a plurality of line-type heads, overlaps, noises due to no-jetting of ink, or curved-shooting of ink are decreased in one line-type head, and a high quality image can be formed.

Still further, in the case where each line-type head is produced by jointing short line-type heads, when joints of small line-type heads of each line-type heads are respectively shifted in the primary scanning direction, image failure generated when short line-type heads are jointed, can be prevented.

(7) The ink-jet printer of item (3), which comprises, a plurality of line-type head groups including a plurality of line-type heads in which each nozzle of each line-type head is located at the same position in the primary scanning direction, wherein, between adjacent nozzles of one line-type head group of the plurality of head groups, nozzles of the other line-type head groups are located.

In the line-type head group, each nozzle of each linetype head is located at the same position in the primary scanning direction, thereby, a plurality of line images can be simultaneously formed, resulting in high speed image formation.

Yet further, when the relative movement in the subsidiary scanning direction of the recording sheet P to line-type head groups is made into such a movement that a band image obtained by one image formation by a plurality of line-type head groups, overlaps, noises due to no-jetting of ink, or curved-shooting of ink are decreased in one line-type head group, and a high quality image can be formed.

In the case where each line-type head is produced by jointing short line-type heads, when joints of small line-type heads of each line-type heads are respectively shifted in the primary scanning direction, image failure generated when short line-type heads are jointed, can be prevented.

Furthermore, when, between adjacent nozzles of one linetype head group of the plurality of head groups, nozzles of the other line-type head groups are located, resolution in the primary scanning direction is improved, and a high quality image can be formed.

Further, even if there is a nozzle defect such as no-jetting of ink or curved-shooting of ink, in any line-type head of a plurality of line-type heads, and noise is generated in an image, the noise is reduced by image formation by using other line-type heads, and high image quality is attained.

BRIEF DESCRIPTION OF THE DRAWINGS

The objects and advantages of the present invention will become apparent upon reading the following detailed description and upon reference to the drawings in which.

DETAILED DESCRIPTION OF THE PREFERRED EMBODIMENT

Figure 1:
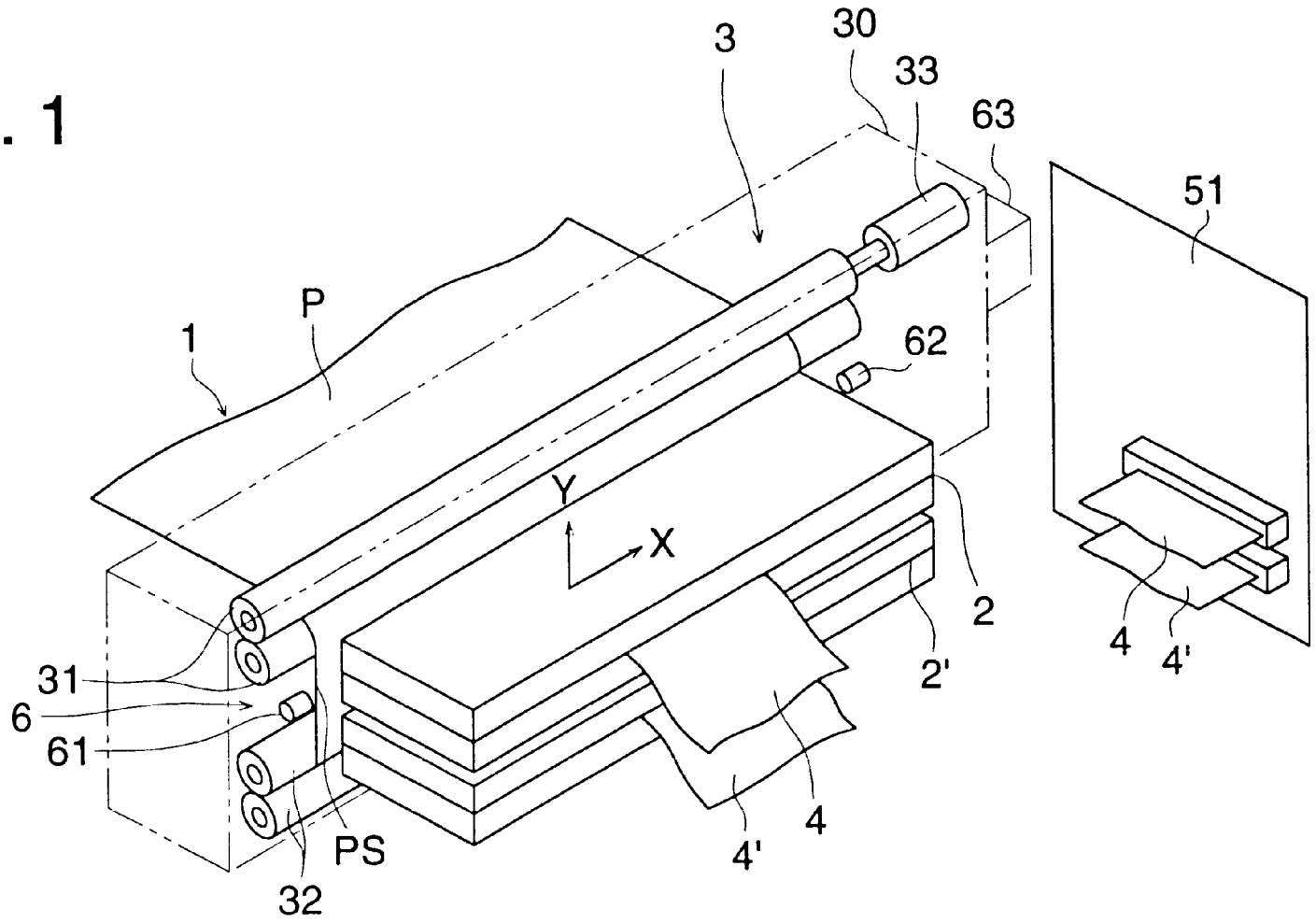
FIG. 1 is a view for explaining the overall structure of a line type ink-jet printer of the first example of the present invention.

Next, referring to the drawings, examples of the present invention will be described.

(1) FIRST EXAMPLE

Initially, referring to FIG. 1, the overall structure of a line type ink-jet printer of the present example will be described below.

In the line type ink-jet printer 1, the recording sheet P as the recording medium is nipped by conveyance roller pairs 31 and 32 of a conveyance mechanism 3, and further, conveyed in the direction Y in the drawing by the conveyance roller pair 31 rotated by a conveyance motor 33.

A line-type head 2 (a first printing head) and an auxiliary head 2' (a second printing head) are provided in parallel in such a manner that these heads face the surface PS of the recording sheet P, between conveyance roller pairs 31 and 32.

The auxiliary head 2' is a line-type head having the same image recording width as that of the line-type head 2.

These line-type head 2 and auxiliary head 2' are connected to a control substrate 51, on which a control section, which will be described later, is provided, through respective flexible cables (hereinafter, called FPC) 4 and 4'.

Figure 2:
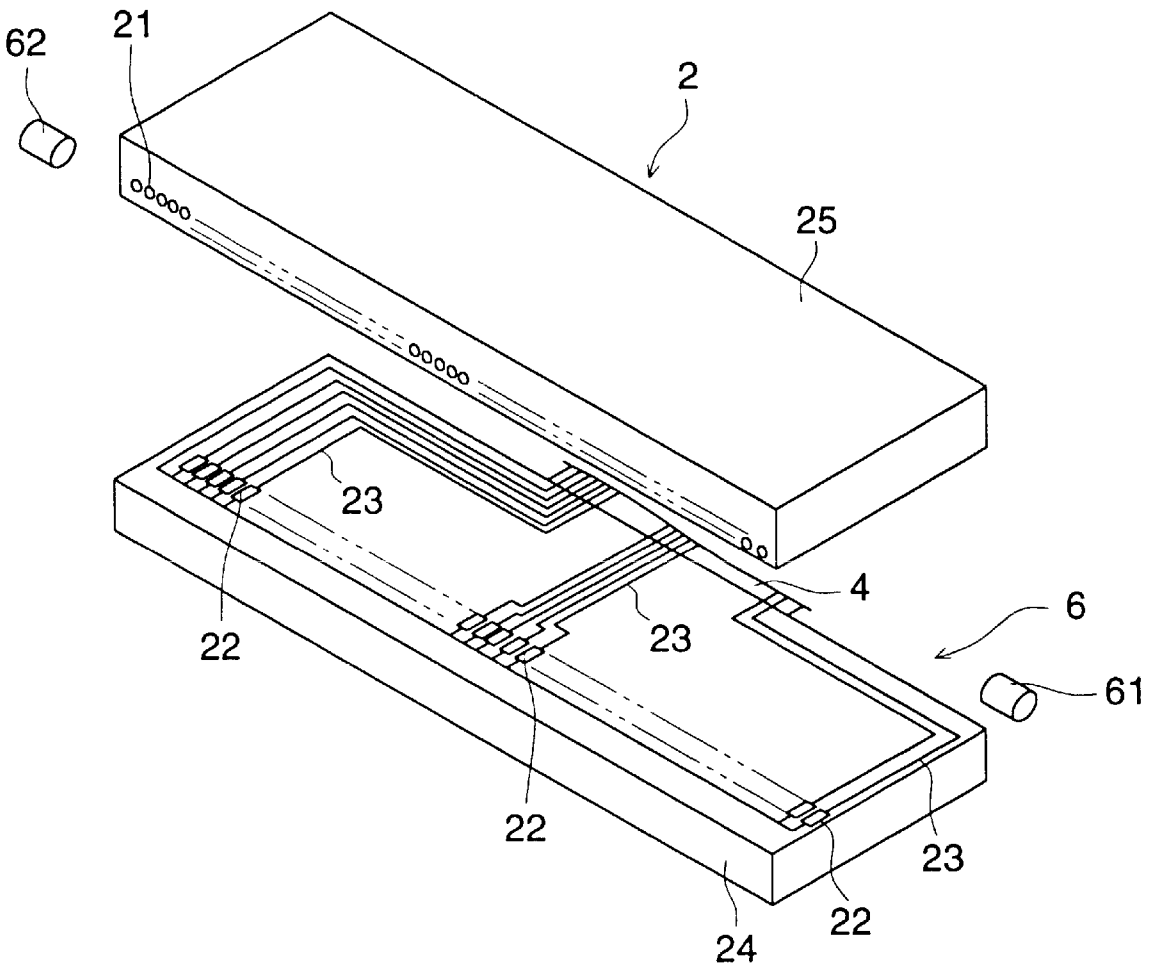
FIG. 2 is a view for explaining the structure of a linetype head shown in FIG. 1.

Further, as shown in FIG. 2, on one side of the line-type head 2, a laser nozzle checking means 6 composed of a laser light source 61 to irradiate laser beams onto liquid drops of ink jetted from nozzles 21, and a light receiving element 62 to receive laser beams, is provided.

Figure 3:
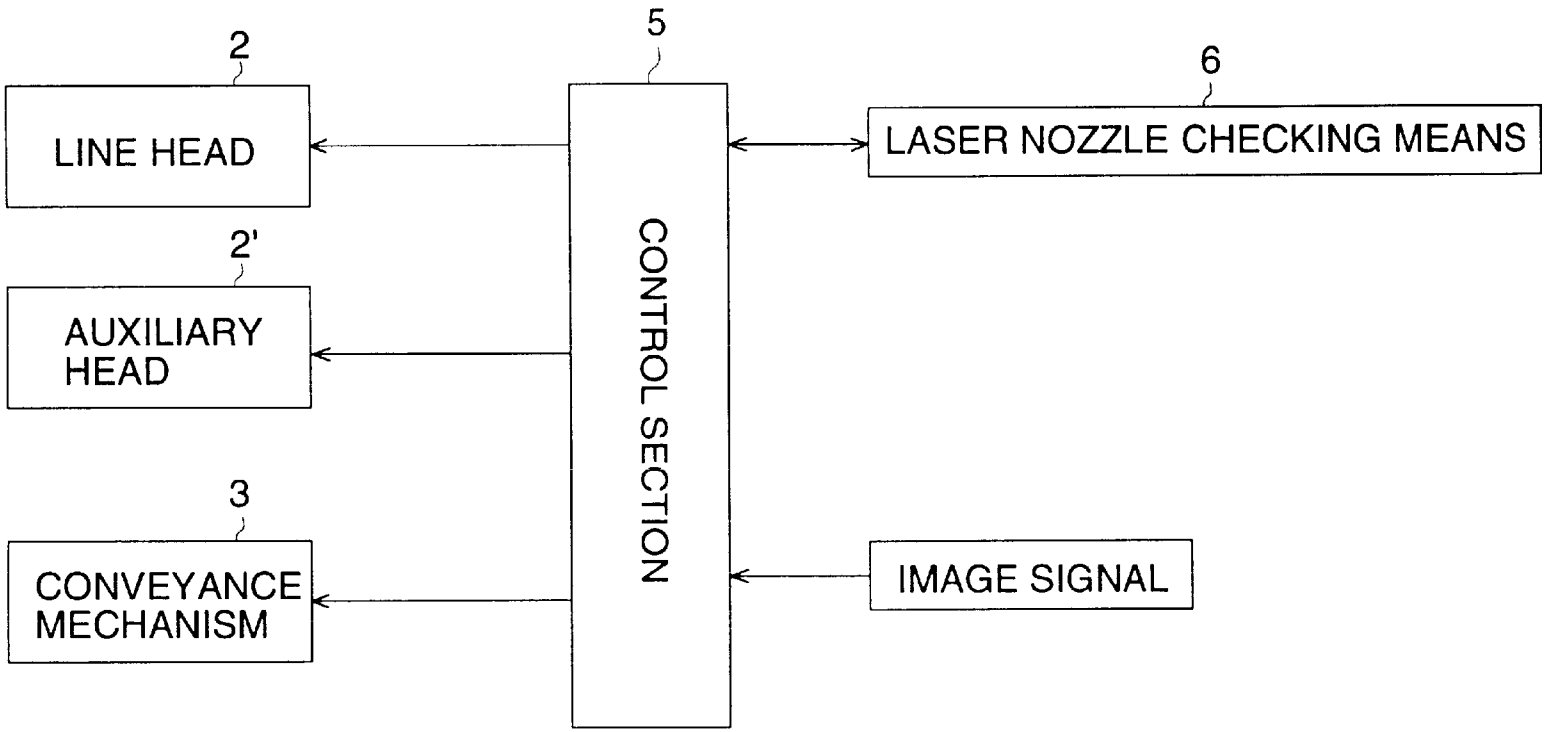
FIG. 3 is a view for explaining electrical connection of the line type ink-jet printer of the first example.

Next, referring to FIG. 3, the electrical connection of the above structure will be described.

In the drawing, numeral 5 is a control section which is provided on the control substrate 51, and reads an image signal, and drives the line-type head 2, auxiliary head 2', conveyance mechanism 3 and laser nozzle checking means 6.

Figure 4:
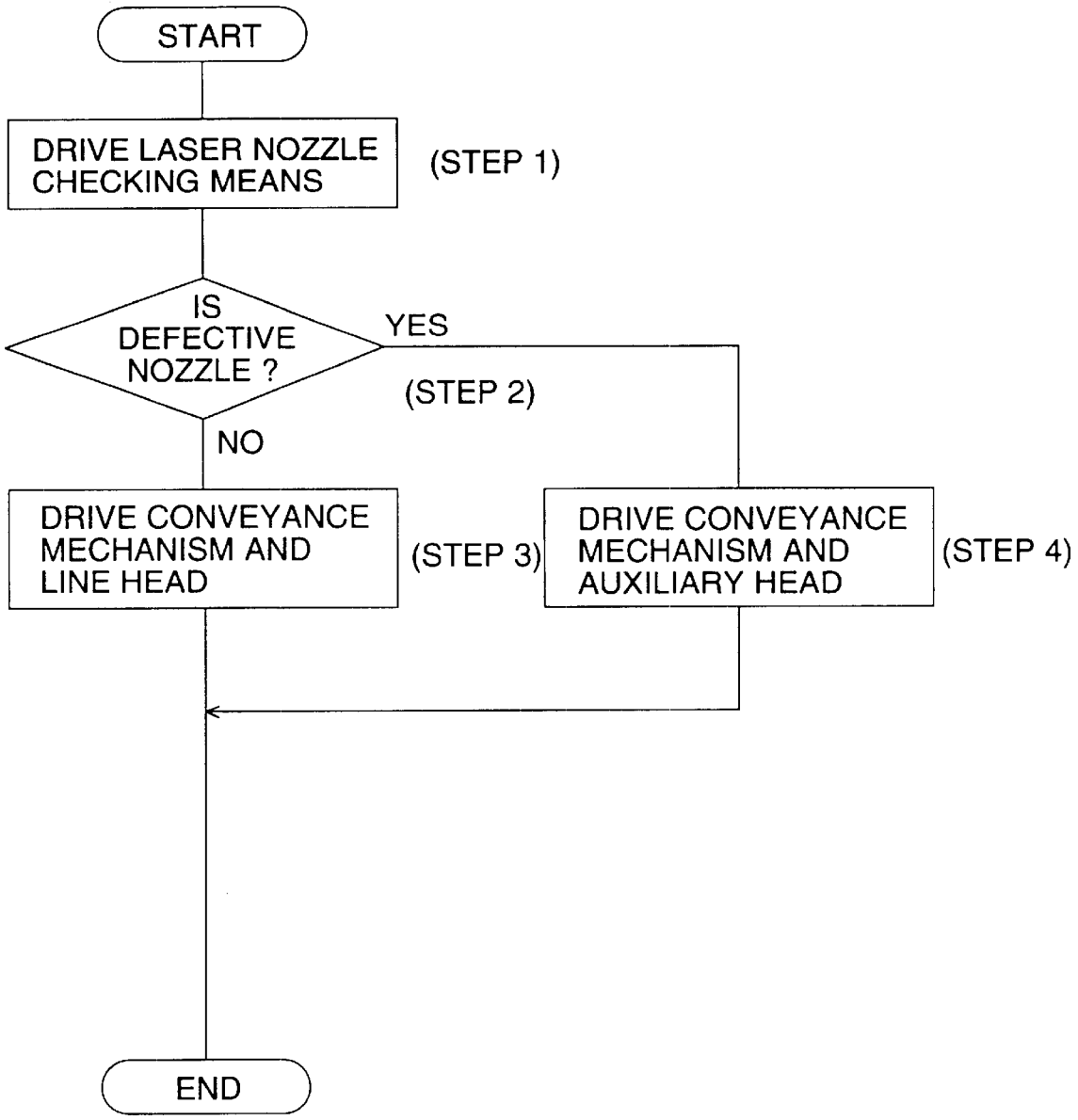
FIG. 4 is a flow chart for explaining operations of the line type ink-jet printer of the first example.

Next, referring to FIG. 4, operations of the above structure will be described.

Initially, existence or not of a nozzle defect of the line-type head 2 is checked by using the laser nozzle checking means (Step 1).

Concretely, under the condition that laser beams are emitted from the laser light source 61, a plurality of nozzles 21 of the line-type head 2 are successively driven one by one. When there is no-jetting of ink or curved-shooting of ink, the laser beams arrive at the light receiving element 62, thereby, a defective nozzle can be specified.

Herein, when there is no defective nozzle, the control section 5 drives the conveyance mechanism 3 to convey the recording sheet P at a constant speed, drives the piezoelectric elements 22 corresponding to an image signal, causes the nozzles 21 of the line-type head 2 to simultaneously jet liquid drops of ink for each line, and forms an image on the recording sheet PS (Steps 2, 3).

Further, when there is a defective nozzle in Step 1, an image is formed by using the auxiliary head 2' (Steps 2, 4).

According to the above structure, when there is any defect in the nozzle 21 of the line-type head 2, image formation is carried out by using the auxiliary head 2' provided in parallel to the line-type head 2, thereby, image failure due to the defect of the nozzle 21 can be improved.

Incidentally, the present invention is not limited to the above example. In the above example, ink-jet using piezoelectric elements 22 as ink-jetting elements is described, however, a high voltage type ink-jet, or an air bubble-burst type ink-jet may also be allowed.

(2) SECOND EXAMPLE

Next, referring to FIG. 5, the second example of the present invention will be described.

Incidentally, the structure of the present example is the same as that of the first example, and operations are different, therefore, only operations will be described below, and description of the structure will be omitted.

Figure 5:
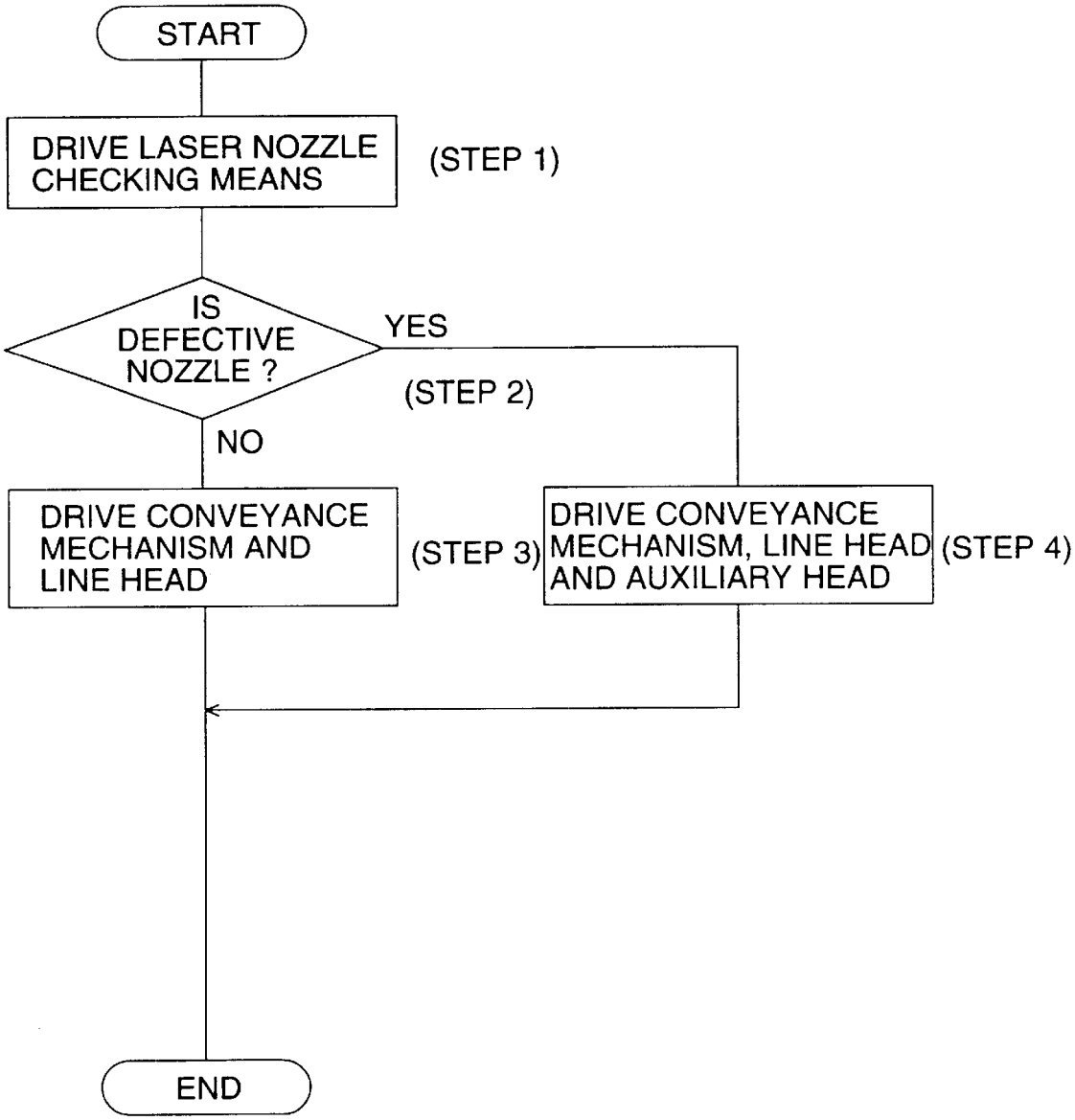
FIG. 5 is a flow chart for explaining operations of the line type ink-jet printer of the second example.

As shown in FIG. 5, initially, existence or not of the nozzle defect of the line-type head 2 is checked by using the laser nozzle checking means (Step 1).

Herein, when there is no defective nozzle, the control section 5 drives the conveyance mechanism 3 to convey the recording sheet P at a constant speed, drives the piezoelectric elements 22 corresponding to an image signal, causes the nozzles 21 of the line-type head 2 to simultaneously jet liquid drops of ink for each line, and forms an image on the recording sheet PS (Steps 2, 3).

Further, when there is a defective nozzle in Step 1, an image is formed by using the line-type head 2 for other portions except the defective nozzle, and by using the auxiliary head 2' for the portion of the defective nozzle (Steps 2, 4).

According to the above structure, when there is any defect in the nozzles 21 of the line-type head 2, image formation is carried out by using the auxiliary head 2' provided in parallel to the line-type head 2, thereby, image failure due to the defect of the nozzle 21 can be improved.

Further, frequency of replacement of the line-type head 2 is decreased, resulting in a decrease of replacement cost, and an increase of reliability.

(3) THIRD EXAMPLE

Figure 6:
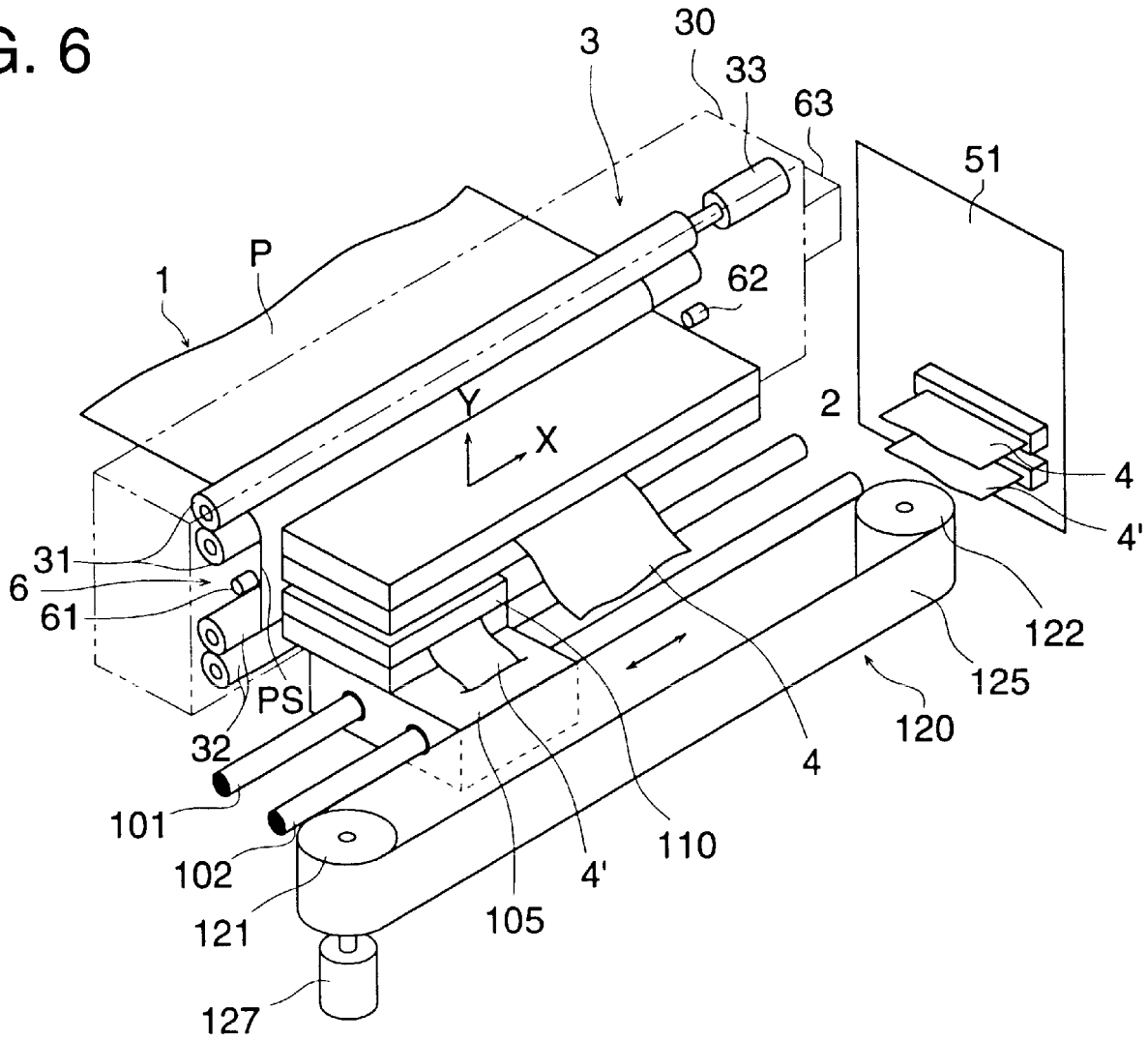
FIG. 6 is a view for explaining the overall structure of a line type ink-jet printer of the third example.

Initially, referring to FIG. 6, the overall structure of the line type ink-jet printer of the present example will be described. Incidentally, the same portions as those in FIG. 1 showing the first example, are denoted by the same numeral codes as in FIG. 1, and the description will be omitted.

The first and second guides 101, 102 are provided in parallel to each other along the line direction of the linetype head 2. A slider 105 provided with an auxiliary head 110 which has at least not less than one nozzle and faces the surface PS of the recording sheet P between the conveyance roller pairs 31 and 32, is movably engaged with these guides.

This slider (auxiliary head) 105 (110) is driven in the direction of the line of the line-type head 2 by an auxiliary head movement mechanism 120 composed of pulleys 121, 122, a belt 125 which is trained around the pulley 121 and 122, and provided with the slider 105, and a motor 127 to drive the pulley 121.

Next, referring to FIG. 7, electrical connection of the above structure will be described.

Figure 7:
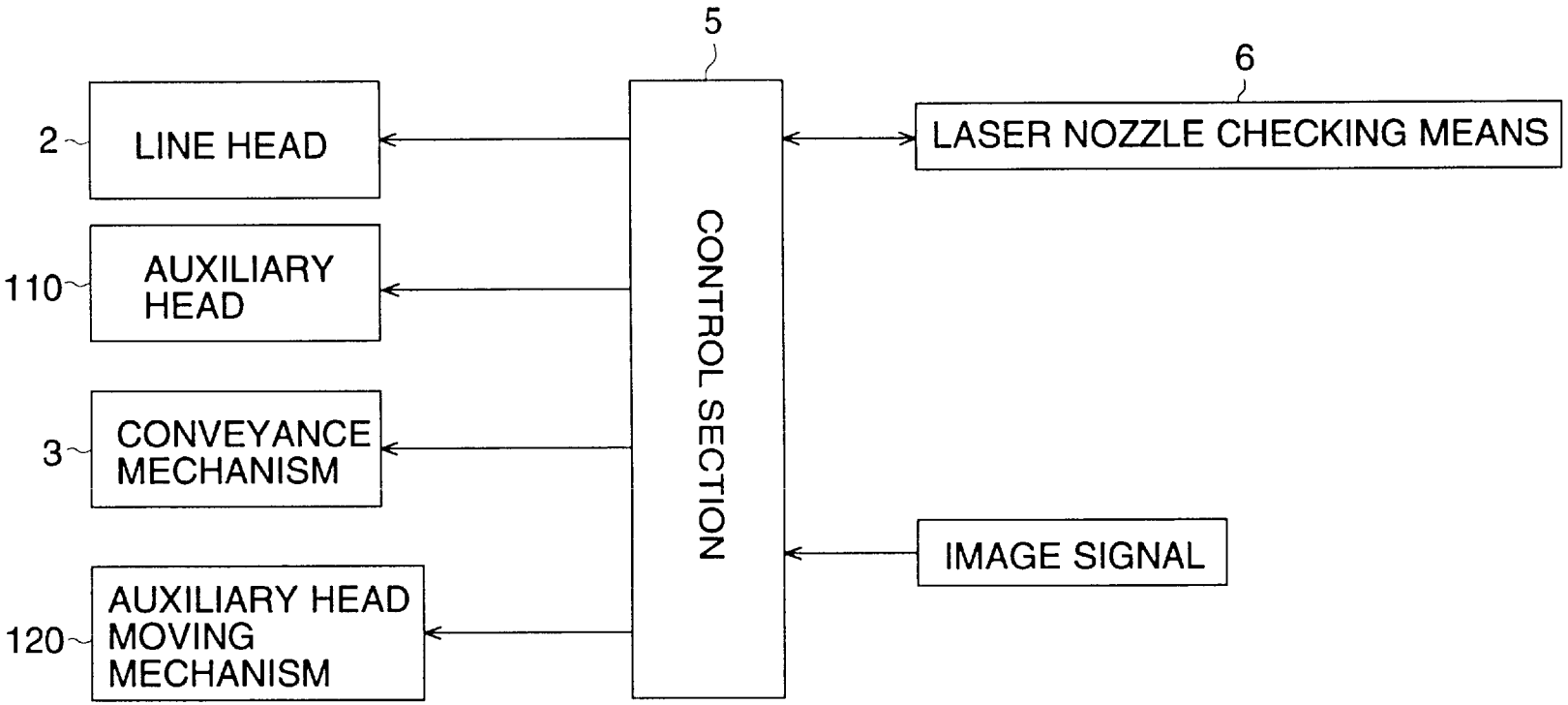
FIG. 7 is a view for explaining electrical connection of the line type ink-jet printer of the third example.

In FIG. 7, numeral 5 is a control section which is provided on the control substrate 51, reads an image signal, and drives the line-type head 2, auxiliary head 110, conveyance mechanism 3, auxiliary head movement mechanism 120, and laser nozzle checking means 6.

Figure 8:
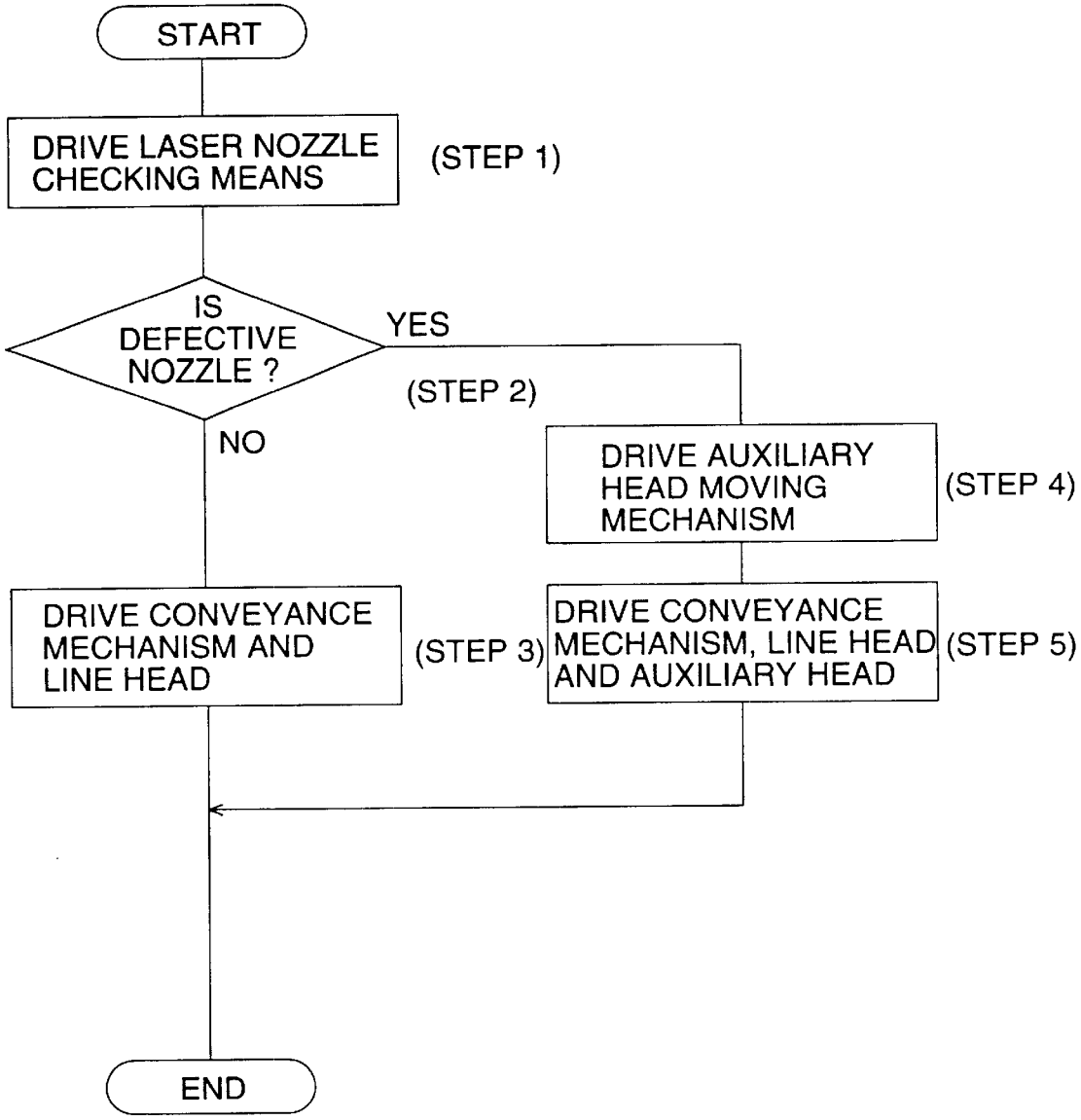
FIG. 8 is a flow chart for explaining operations of the line type ink-jet printer of the third example.

Next, referring to FIG. 8, operations of the above structure will be described.

Initially, existence or not of a nozzle defect of the line-type head 2 is checked by using the laser nozzle checking means (Step 1).

Herein, when there is no defective nozzle, the control section 5 drives the conveyance mechanism 3 to convey the recording sheet P at a constant speed, drives the piezoelectric elements 22 corresponding to an image signal, causes the nozzles 21 of the line-type head 2 to simultaneously jet liquid drops of ink for each line, and forms an image on the recording sheet PS (Steps 2, 3).

Further, when there is a defective nozzle in Step 1, the auxiliary head movement mechanism 120 is driven to move the auxiliary head 110 to the position corresponding to the defective nozzle (Steps 2, 4).

An image is formed by using the line-type head 2 for other portions except the defective nozzle, and by using the auxiliary head 110 for the portion of the defective nozzle (Step 5).

According to the above structure, when there is any defect in the nozzles 21 of the line-type head 2, image formation is carried out by using the auxiliary head 110 instead of the line-type head 2, thereby, image failure due to the defect of the nozzle 21 can be improved.

Further, frequency of replacement of the line-type head 2 is decreased, resulting in a decrease of replacement cost, and an increase of reliability.

(4) FOURTH EXAMPLE

Figure 9:
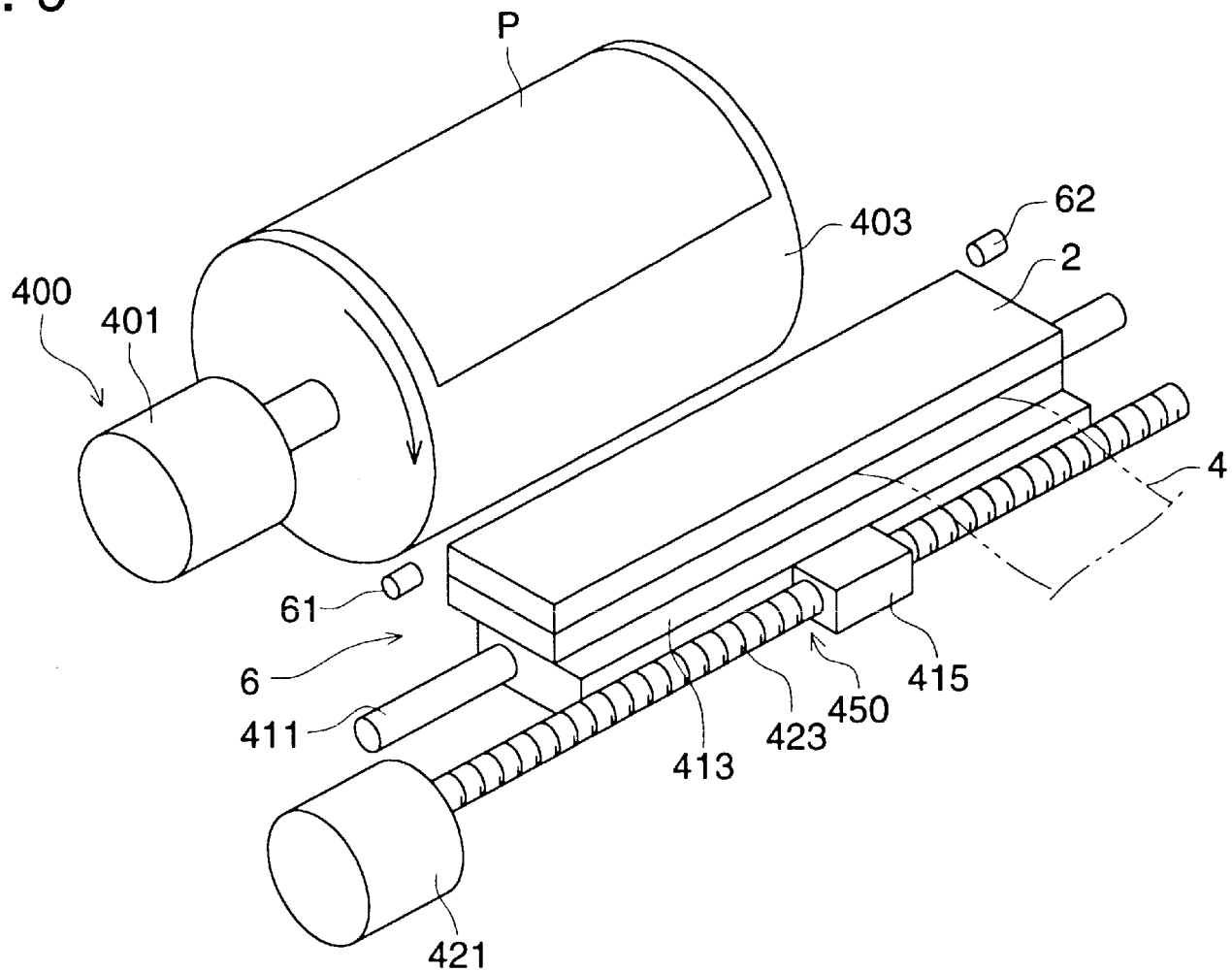
FIG. 9 is a view for explaining the overall structure of a line type ink-jet printer of the fourth example.

Initially, referring to FIG. 9, the overall structure of the line type ink-jet printer of the present example will be described. Incidentally, the same portions as those in FIG. 1 showing the first example, are denoted by the same numeral codes as in FIG. 1, and the description will be omitted.

A conveyance mechanism 400 of the present example is composed of a drum 403 on the peripheral surface of which the recording sheet P is placed, and a drum driving motor 401 to rotate the drum 403 around the rotation axis.

The line-type head 2 can move in the line direction of the line-type head 2 by a line-type head movement mechanism 450, composed of a guide 411 provided in the line direction of the line-type head 2, a slider 413 which is provided with the line-type head 2 and movably engaged with the guide 411, a screw rod 423 provided in parallel with the guide 411, a screw rod driving motor 421 to rotate the screw rod 423, and a nut member 415 which is fitted on the side surface of the slider 413 and screwed with the screw rod 423.

Figure 10:
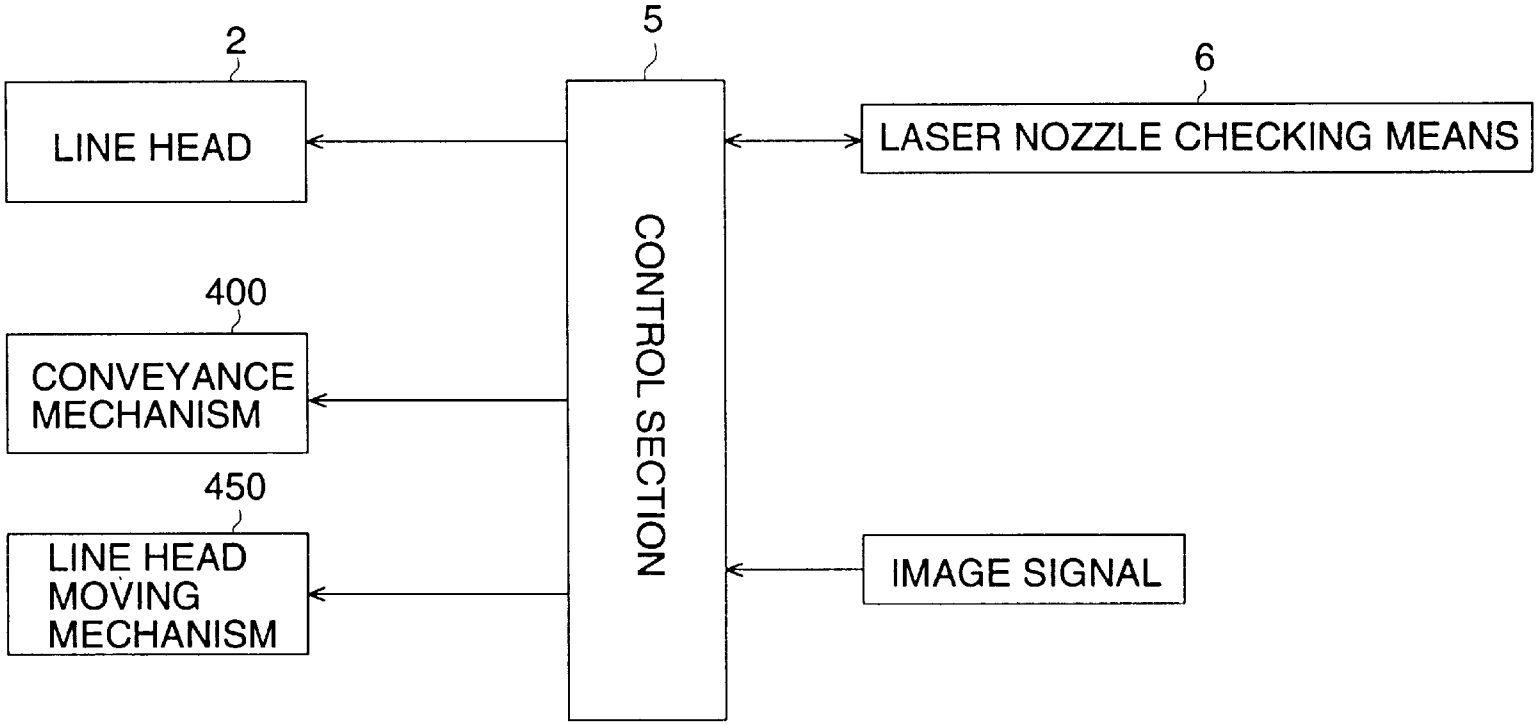
FIG. 10 is a view for explaining electrical connection of the line type ink-jet printer of the fourth example.

Next, referring to FIG. 10, the electrical connection of the above structure will be described.

In the drawing, numeral 5 is a control section which reads in an image signal and drives the line-type head 2, conveyance mechanism 400, line-type head movement mechanism 450, and laser nozzle checking means 6.

Figure 11:
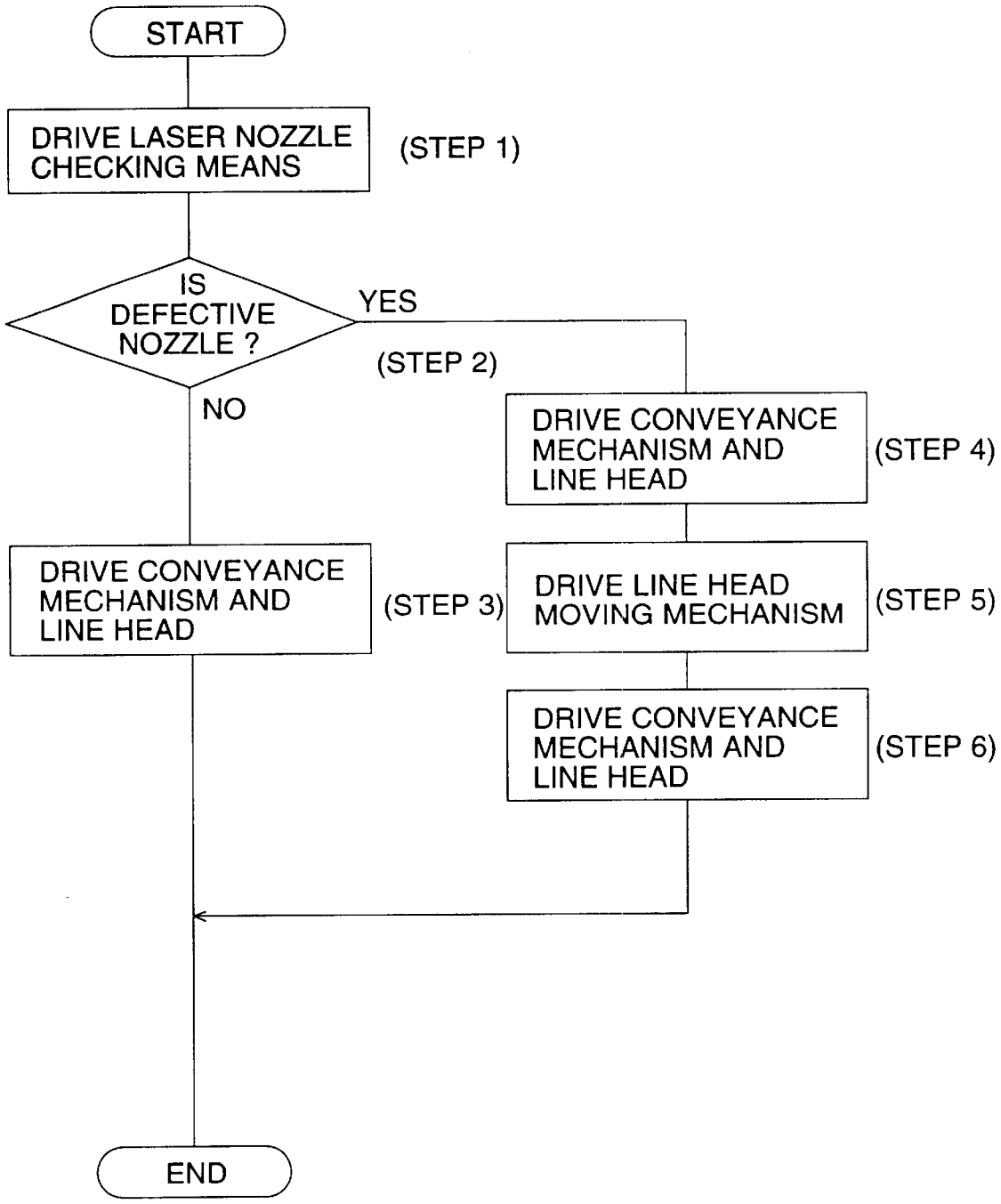
FIG. 11 is a flow chart for explaining operations of the line type ink-jet printer of the fourth example.
Figure 12:
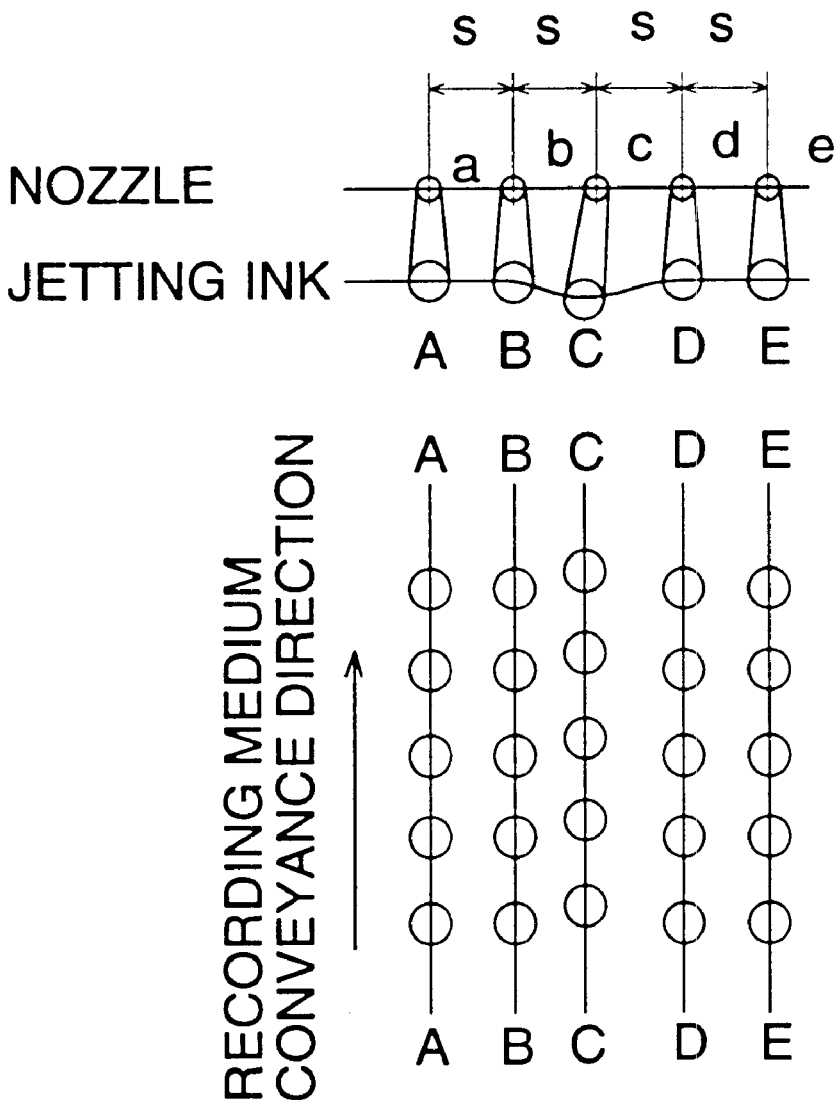
FIG. 12 is an enlarged view of dot images formed on the recording medium by the jetted ink from nozzles of a line-type head.

Next, referring to FIG. 11, operations of the above structure will be described.

Initially, existence or not of the nozzle defect of the line-type head 2 is checked by using the laser nozzle checking means (Step 1).

Herein, when there is no defective nozzle, the control section 5 rotates the recording sheet P at the constant angular velocity by using the conveyance mechanism 400, drives the piezoelectric elements 22 corresponding to an image signal, causes the nozzles 21 of the line-type head 2 to simultaneously jet liquid drops of ink for each line, and forms an image on the recording sheet P (Steps 2, 3).

Further, when there is a defective nozzle in Step 1, image formation is conducted a plurality of times. That is, the control section 5 rotates the recording sheet P at the constant angular velocity by using the conveyance mechanism 400, drives the piezoelectric elements 22 corresponding to an image signal, causes the nozzles 21 of the line-type head 2 to simultaneously jet liquid drops of ink for each line, and conducts the first time image formation on the recording sheet P (Steps 2, 4).

Next, the control section 5 drives the line-type head movement means 450, and moves the line-type head 2 in the line direction (Step 5).

Then, the control section 5 rotates the recording sheet P at the constant angular velocity by using the conveyance mechanism 400, drives the piezoelectric elements 22 corresponding to an image signal, causes the nozzles 21 of the line-type head 2 to simultaneously jet liquid drops of ink for each line, and conducts the second image formation on the recording sheet P (Steps 6).

According to the above structure, when there is any defect in the nozzles 21 of the line-type head 2, the second time image formation, among a plurality of image formation operations (in the present example, two time image formation), is carried out by moving the line-type head 2 in the line direction of the line-type head 2, and image formation of the defective portion is conducted by using other normal nozzles 21. As a result, image failure due to the defect of a nozzle 21 can be improved.

Further, frequency of replacement of the line-type head 2 is decreased, resulting in a decrease of replacement cost, and an increase of reliability.

Further, the present example can be applied to line type ink-jet printers as described in the first–third examples. However, when the first time image formation has been completed, it is necessary to re-set the recording sheet P manually, or by using any other appropriate mechanism.

On the other hand, in the line type ink-jet printer in the present example, the recording sheet P is placed on the circumferential surface of the drum 403, and by rotating the drum 403, the recording sheet P is conveyed in the subsidiary scanning direction.

According to such structure, when a plurality of image formation operations are carried out, it is not necessary to re-set the recording sheet P, and the mechanism thereby becomes simple, as compared to the line type ink-jet printers in the first–third examples.

Incidentally, the present invention is not limited to the above-described example. In the above-described example, the image formation is carried out two times in total, however, when the image formation is carried out three times in total, and at least one of the image formation operations is carried out by moving the line-type head 2 in the line direction, the effects of the present example can be obtained.

(5) FIFTH EXAMPLE

Figure 13:
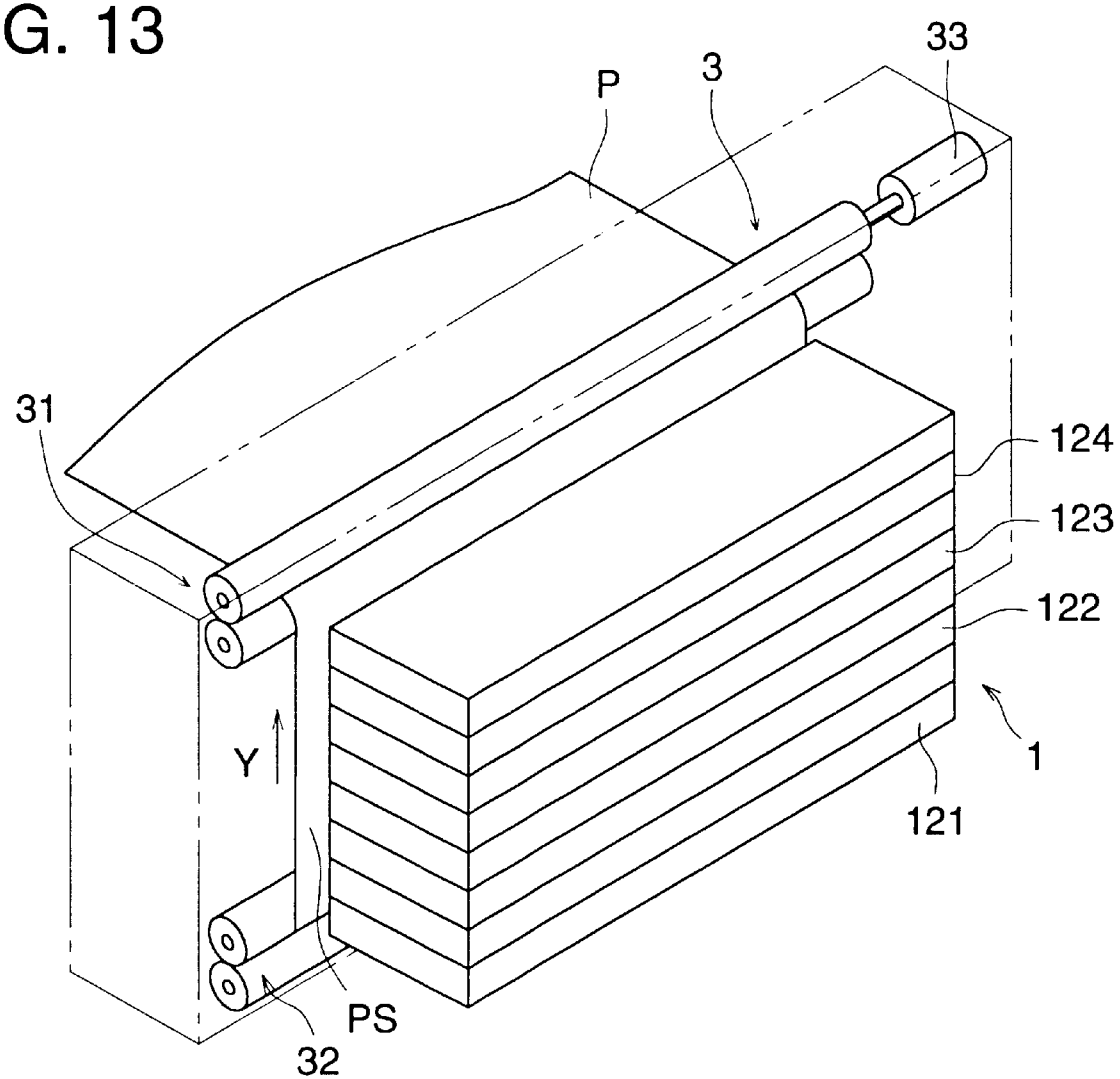
FIG. 13 is a view for explaining the overall structure of an ink-jet printer of the fifth example.
Figure 20:
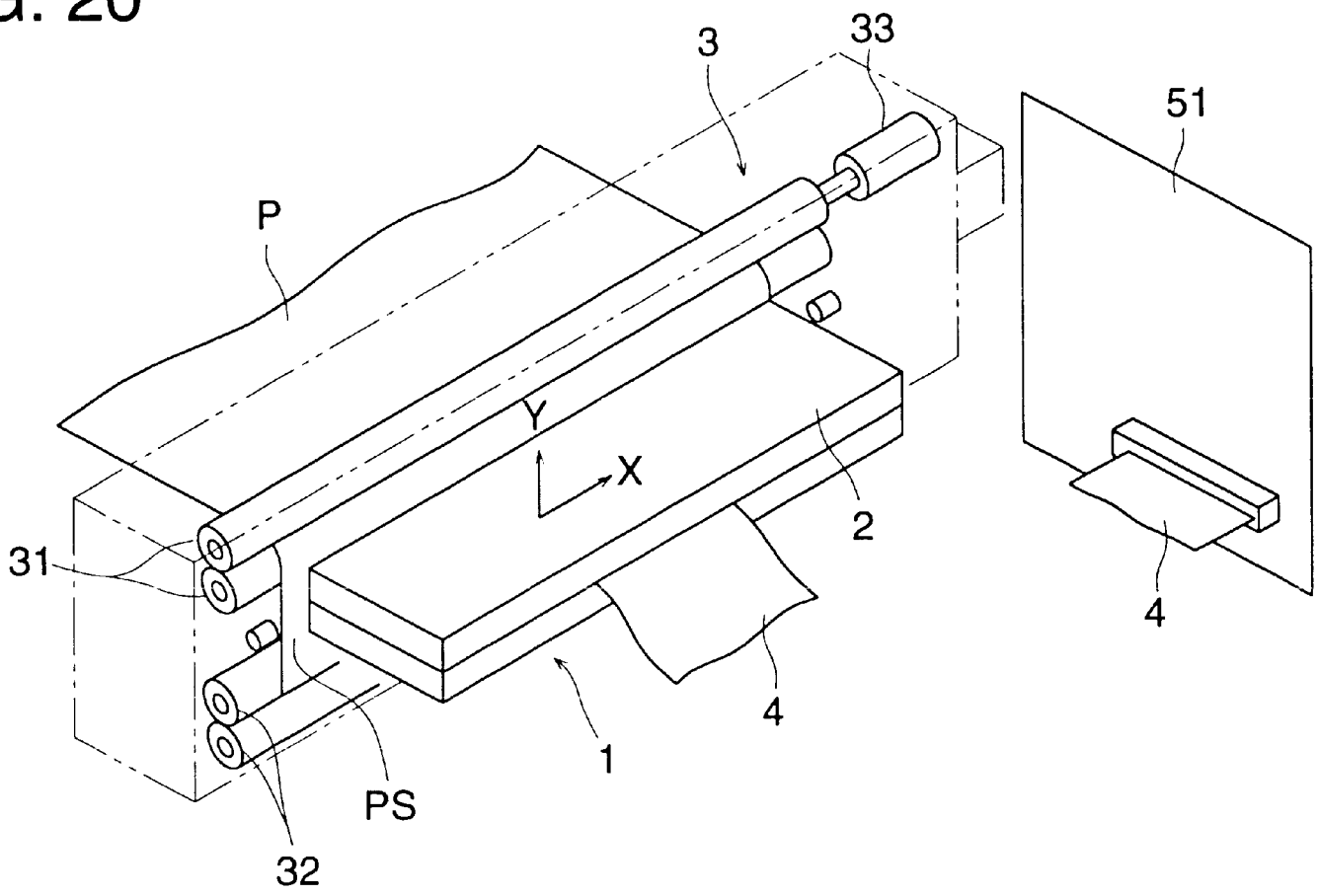
FIG. 20 is a view showing an example of the ink-jet printer having the conventional line-type head.

Referring to FIG. 13, the overall structure of the ink-jet printer of the fifth example will be described below. Incidentally, the same parts as those shown in FIG. 20 showing the conventional example and FIG. 2, are denoted by the same numerical codes as in FIGS. 20 and 2, and the description of these parts will be omitted.

In the drawing, the first–fourth stacked line-type heads 121, 122, 123, and 124 are provided in such a manner that the line-type heads face the surface PS of the recording sheet P as the recording medium between conveyance roller pairs 31 and 32. These first–fourth line-type heads 121, 122, 123 and 124 respectively jet liquid drops of the same color ink, and each structure of them is the same as the line-type head 2 described in the conventional example.

Figure 14:
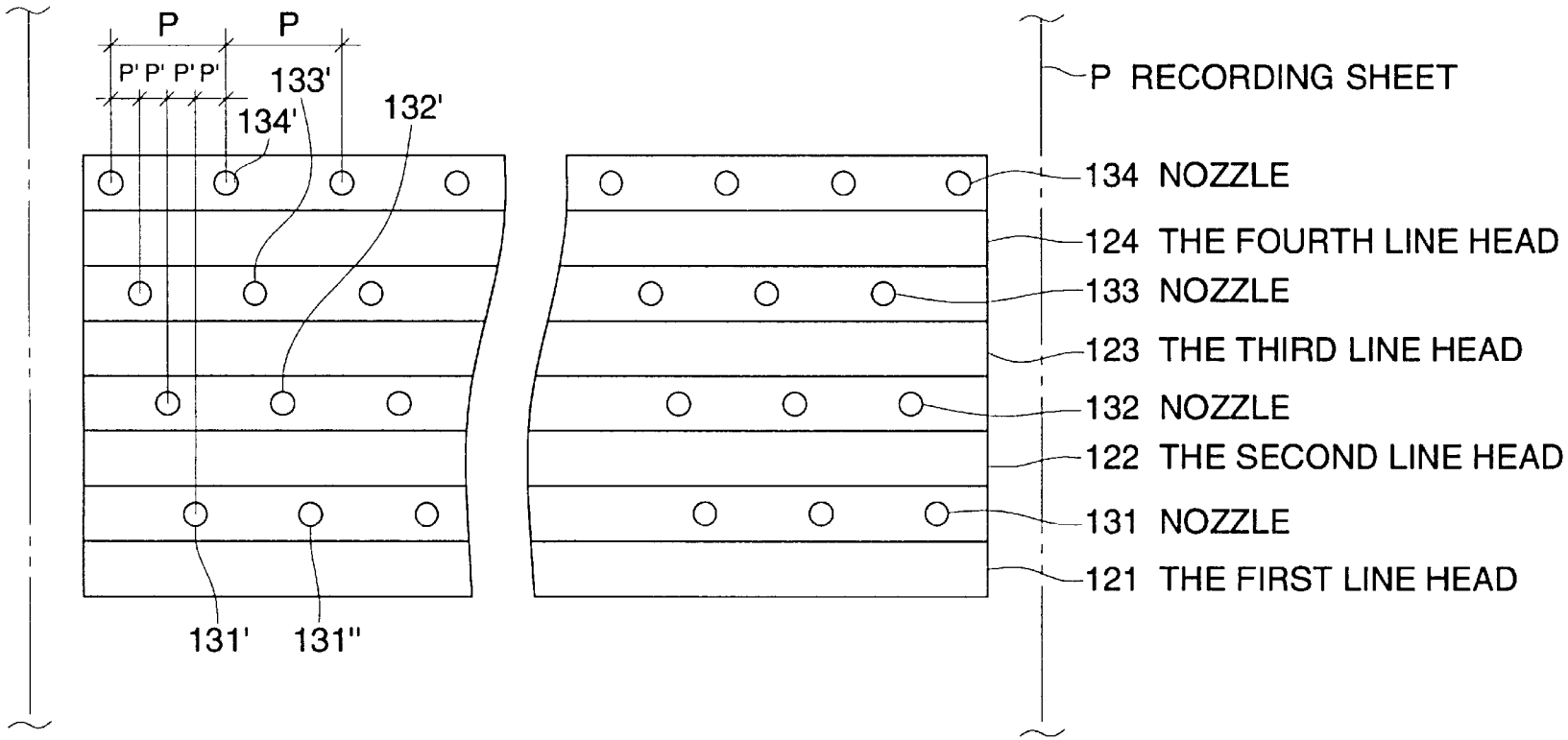
FIG. 14 is a structural view for explaining the surface on the nozzle side of the first–fourth line-type heads in FIG. 1.

Referring to FIG. 14, the surface on the nozzle side of the first–fourth line-type heads 121, 122, 123, and 124 will be described below.

A plurality of nozzles 131, 132, 133 and 134, each having a pitch (P) of 180 dpi (dots per inch) in the primary scanning direction, are formed in the first–fourth line-type heads 121, 122, 123 and 124.

The first–fourth line-type heads 121, 122, 123 and 124 are arranged in the primary scanning direction respectively by being shifted by 720 dpi each.

That is, each one of nozzles 132', 133' and 134' of the second–fourth line-type heads 122, 123 and 124 is respectively located between adjacent nozzles 131' and 131" of the first line-type head.

Next, operations of the above-described structure will be described. The control section drives the conveyance mechanism 3 to convey the recording sheet P at constant speed, drives the piezoelectric element 22 of each of line-type heads 121, 122, 123 and 124, and causes nozzles 131, 132, 133 and 134 of line-type heads 121, 122, 123 and 124 to jet liquid drops of ink, thereby, forms an image on the recording sheet P.

According to the ink-jet printer structured as described above, when 4 line-type heads 121, 122, 123 and 124, having nozzles 131, 132, 133 and 134 each having a pitch (P) of 180 dpi, are respectively arranged by being shifted by 720 (180×4) dpi each, the resolution of the formed image is 720 dpi, and a high quality image is obtained.

Further, even if there is any nozzle defect such as no-jetting of ink, curved-shooting of ink, or the like, in any line-type head of a plurality of line-type heads 121, 122, 123 and 124, and noise is generated on the image, noise is decreased by the image formation by using other line-type heads, thereby the image quality becomes high.

Incidentally, the present invention is not limited to the above-described example. In the above example, ink-jet using piezoelectric elements 22 as ink-jetting elements is described, however, a high voltage type ink-jet, or an air bubble-burst type ink-jet may also be allowed.

(6) SIXTH EXAMPLE

Figure 15:
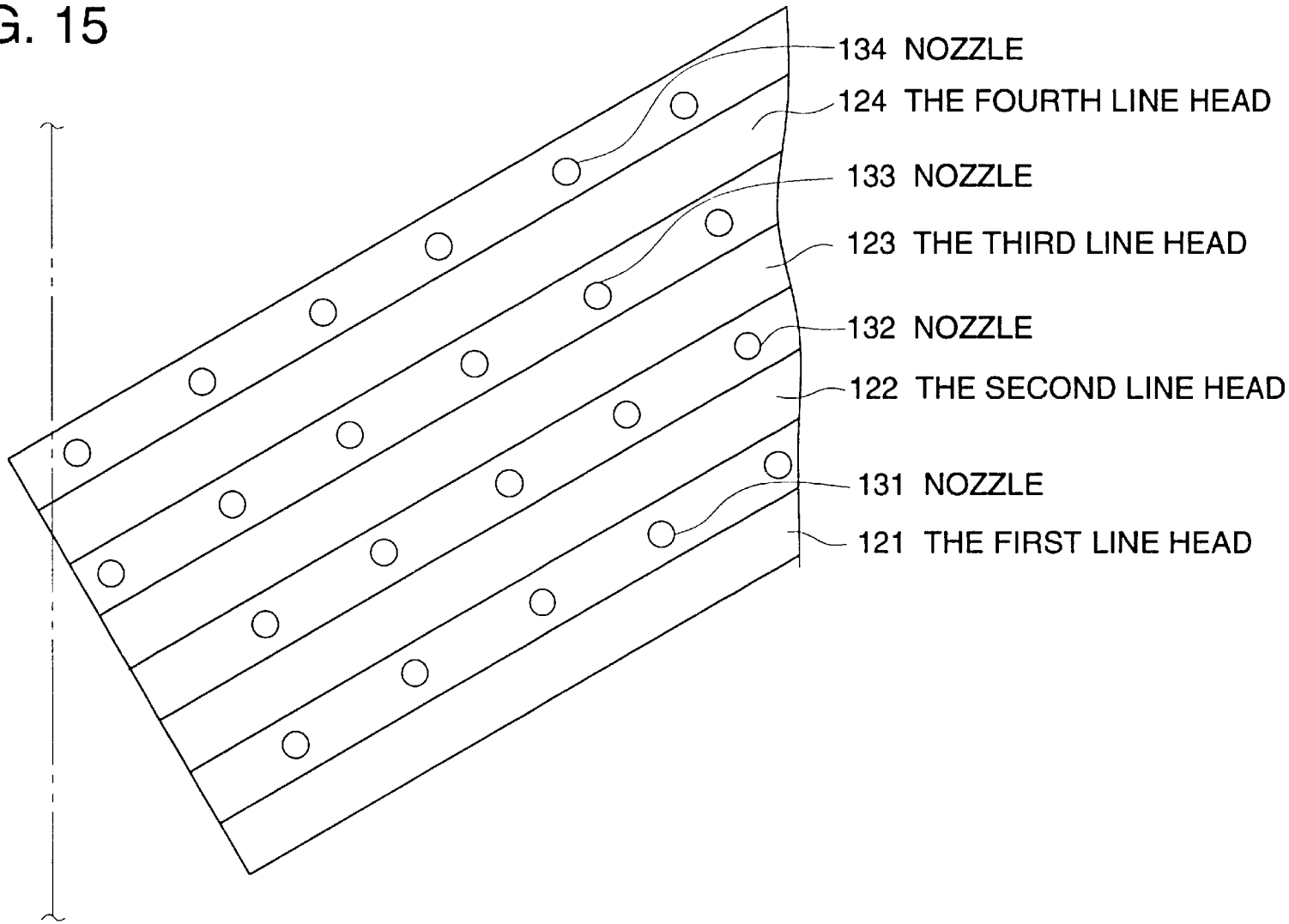
FIG. 15 is a structural view of an inventive portion of the sixth example.

Referring to FIG. 15, the sixth example of the present invention will be described below. The difference between the present example and the fifth example is as follows: nozzles 131, 132, 133, 134 of line-type heads 121, 122, 123 and 124 are arranged in the primary scanning direction in the fifth example, but in the present example, the first–fourth heads 121, 122, 123, and 124 are arranged to cross the primary scanning direction.

According to the above structure, in addition to the effect of the fifth example, pitches of nozzles 131, 132, 133 and 134 of line-type heads 121, 122, 123 and 124 in the primary scanning direction are reduced, the resolution is increased, thereby, image formation with high image quality can be carried out.

Further, when a plurality of line-type heads 121, 122, 123 and 124 are provided, movement distance of the recording sheet P in the subsidiary scanning direction is reduced, and the image formation speed is not reduced.

(7) SEVENTH EXAMPLE

Figure 16:
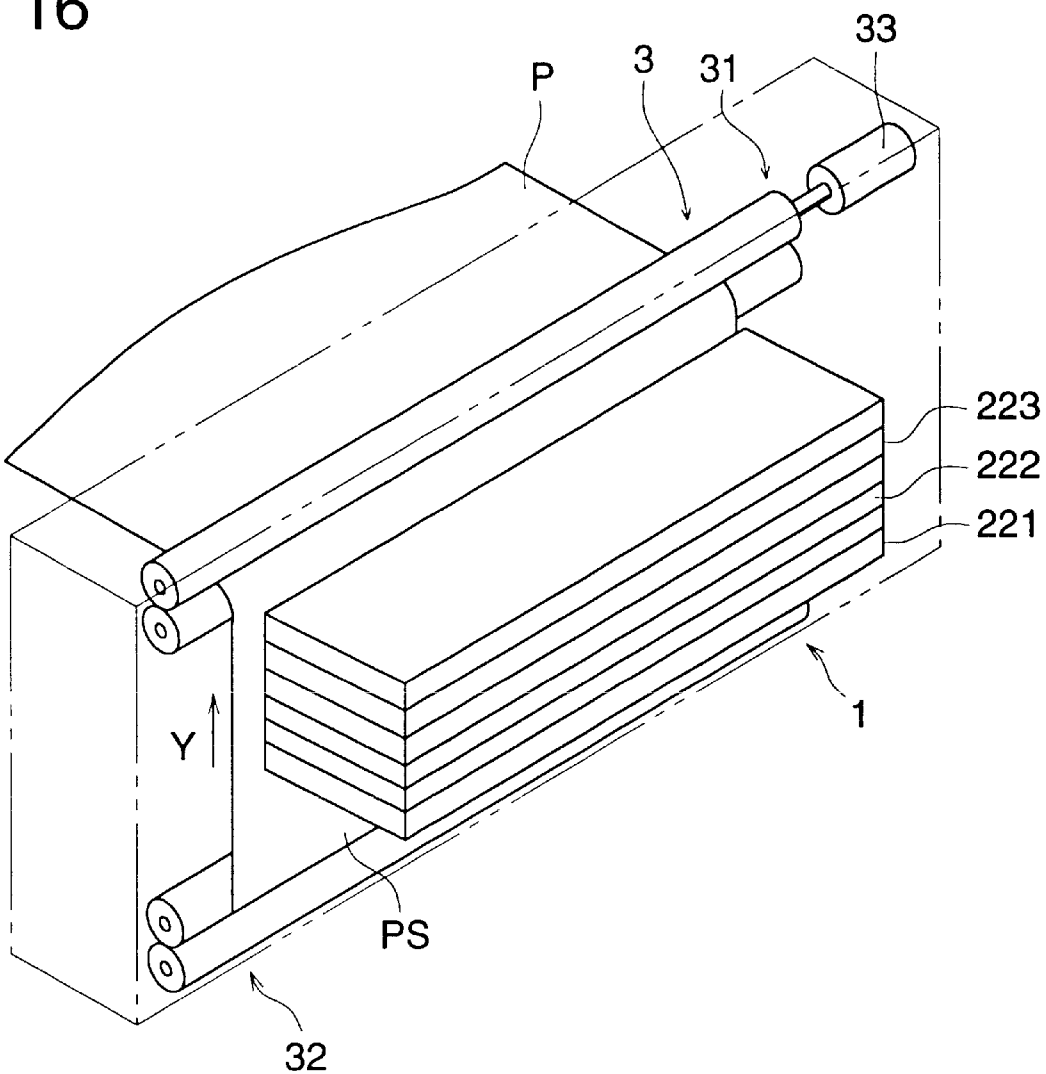
FIG. 16 is a view for explaining the overall structure of the ink-jet printer of the seventh example.

Referring to FIG. 16, the overall structure of an ink-jet printer of the seventh example will be described. The same parts as in FIG. 20 showing the conventional example and FIG. 2, are denoted by the same numeral codes as in FIG. 20 and FIG. 2, and explanation of them will be omitted.

In the drawing, the first–third line-type heads 221, 222, and 223 which are stacked to face the surface PS of the recording sheet P as the recording medium, are provided between the conveyance roller pairs 31 and 32. These first–third line-type heads 221, 222, and 223 respectively jet liquid drops of ink with the same color, and each structure is the same as the line-type head 2 described in the conventional example.

Figure 17:
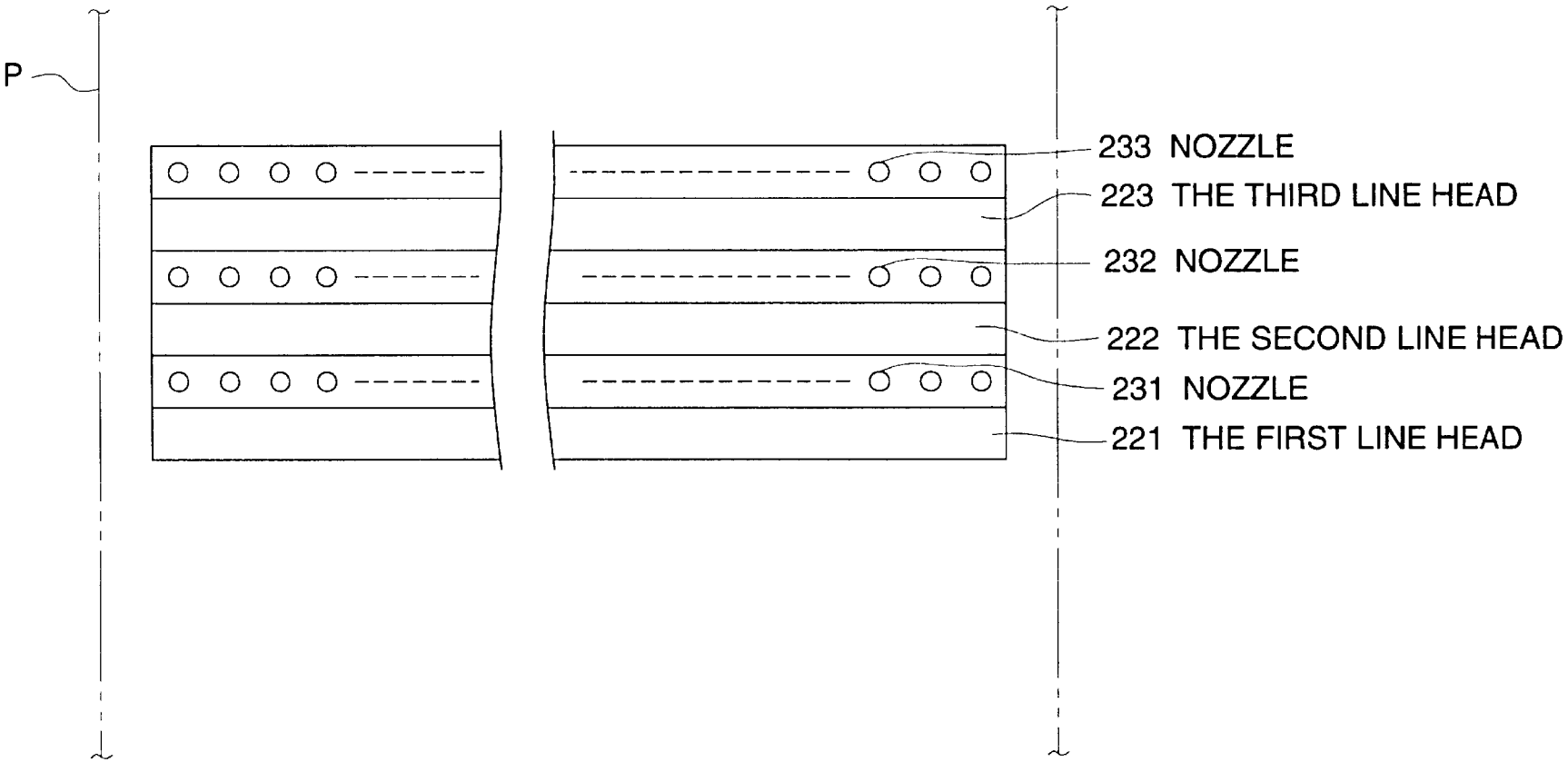
FIG. 17 is a structural view for explaining the surface on the nozzle side of the first–third line-type heads in FIG. 4.

Next, referring to FIG. 17, the surface of the nozzle side of the first–third line-type heads 221, 222, and 223 will be described.

A plurality of nozzles 231, 232, 233 with the same pitch are formed in the primary scanning direction in first–third line-type heads 221, 222, and 223.

The first–third line-type heads 221, 222, and 223 are arranged in such a manner that respective nozzles 231, 232 and 233 are located at the same position in the primary scanning direction.

Next, operations of the above structure will be described. The control section conveys the recording sheet P at a constant speed by using the conveyance mechanism 3.

The control section drives the piezoelectric element 22 of the first line-type head 221 corresponding to the image signal, drives the nozzle 231 of the first line-type head 221 to jet liquid drops of ink, and an image of 1 line is formed on the recording sheet P in the primary scanning direction.

Simultaneously, a line image next to the line image formed by the first line-type head 221 is formed by using the second line-type head 222.

Further, a line image next to the line image formed by the second line-type head 222 is formed by using the third line-type head 223.

According to the ink-jet printer having the above-described structure, a plurality of line images can be simultaneously formed, therefore, high speed image formation can be carried out.

(8) EIGHTH EXAMPLE

Figure 18:
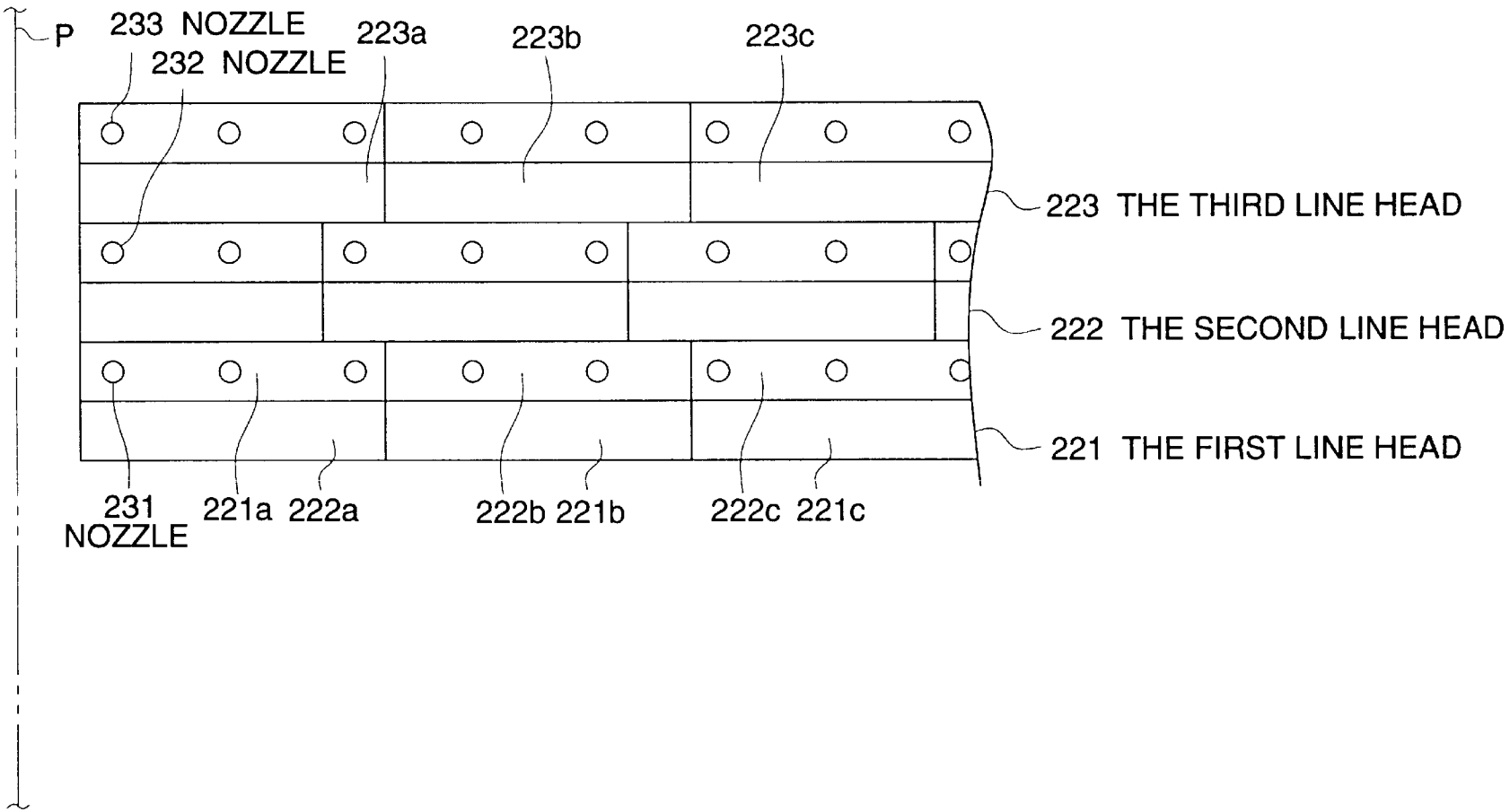
FIG. 18 is a structural view on the nozzle side of the line-type head of the eighth example.

Referring to FIG. 18, the eighth example will be described below. FIG. 18 is a structural view of the nozzle side of the line-type heads of the eighth example of the present invention. The same portions as in FIG. 17 showing the seventh example are denoted by the same numeral codes as in FIG. 17, and description for them will be omitted.

In the present example, the first line-type head 221 is produced by jointing short line-type heads 221*a*, 221*b*, 221*c*, . . . .

The second line-type head 222 is produced by jointing short line-type heads 222*a*, 222*b*, 222*c*, . . . .

The third line-type head 223 is produced by jointing short line-type heads 223*a*, 223*b*, 223*c*, . . . .

Joints of short line-type heads 221*a*, 221*b*, 221*c*, 222*a*, 222*b*, 222*c*, . . . , 223*a*, 223*b*, 223*c*, . . . , of line-type heads 221, 222 and 223 are arranged by respectively being shifted in the primary scanning direction.

According to such the structure, in addition to effects of the seventh example, the following problems can be eliminated: a problem of image failure generated by jointing the short line-type heads, that is, a problem in which nozzles with different liquid drop jetting characteristic exist in one line, thereby, image failure is generated on the recording sheet P, and a problem in which nozzle pitches are different at joints.

(9) NINTH EXAMPLE

Figure 19:
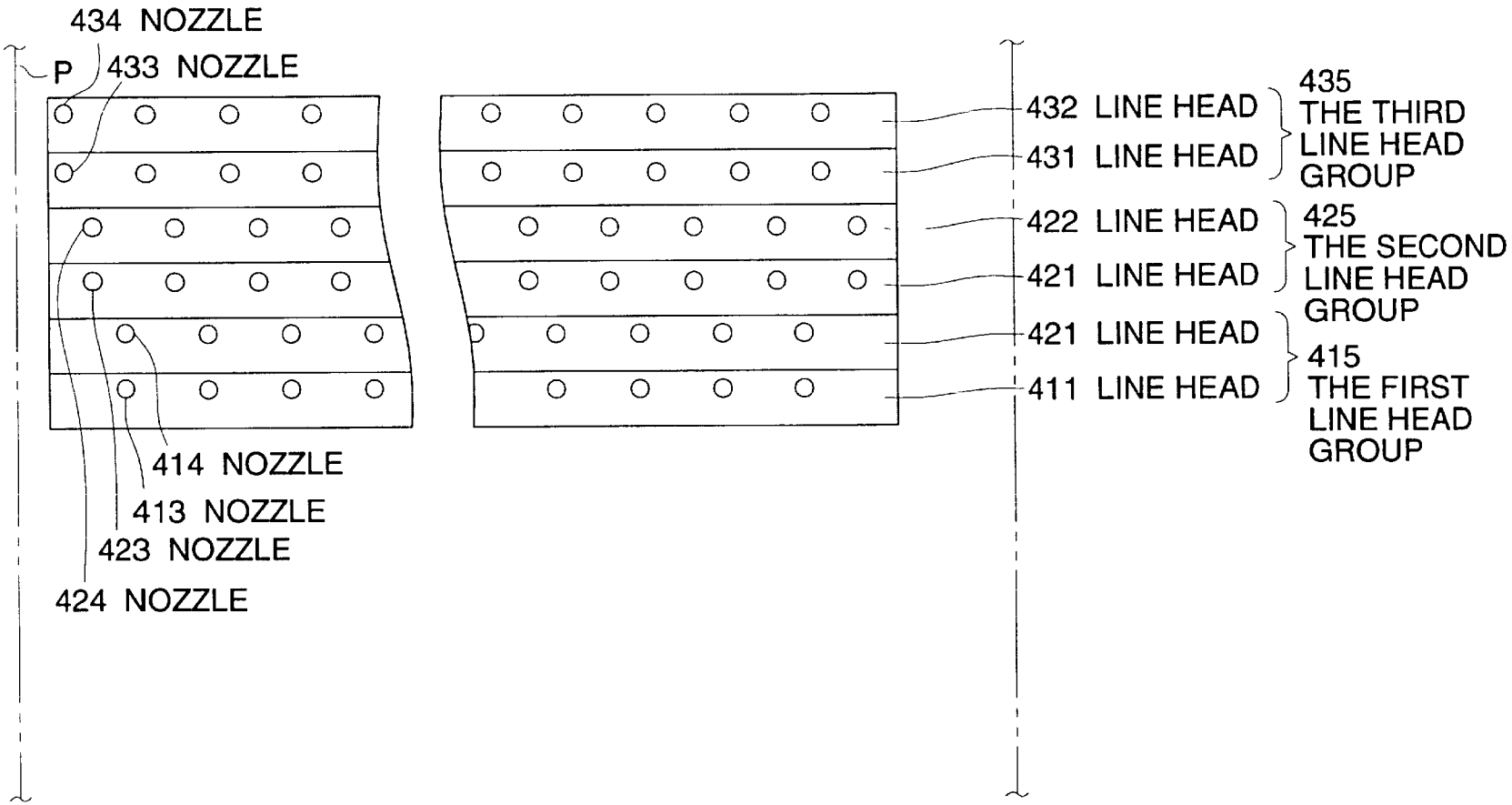
FIG. 19 is a structural view on the nozzle side of the line-type head of the ninth example.

Referring to FIG. 19, the ninth example of the present invention will be described below. FIG. 19 is a structural view of the nozzle side of the line-type head of the ninth example of the present invention.

In the drawing, numeral 415 is the first line-type head group composed of line-type heads 411 and 412 in which positions of nozzles 413 and 414 are the same in the primary scanning direction.

Numeral 425 is the second line-type head group composed of line-type heads 421 and 422 in which positions of nozzles 423 and 424 are the same in the primary scanning direction.

Numeral 435 is the third line-type head group composed of line-type heads 431 and 432 in which positions of nozzles 433 and 434 are the same in the primary scanning direction.

Nozzles 413, 414, 423, 424, 433 and 434 of these first–third line-type head groups 415, 425 and 435 are arranged by being shifted respectively by a predetermined pitch in the primary scanning direction.

That is, these nozzles are arranged such that, between adjacent nozzles of one line-type head group of the first–third line-type head groups 415, 425 and 435, nozzles of the other line-type head groups are located.

According to such the structure, in each of line-type head groups 415, 425 and 435, when each nozzle of each line-type head is located at the same position in the primary scanning direction, a plurality of line images can be simultaneously formed, resulting in high speed image formation.

Further, when the relative movement in the subsidiary scanning direction of the recording sheet P to line-type head groups 415, 425 and 425 is made into such a movement that a band image obtained by one time image formation by a plurality of line-type head group 415, 425 and 435, overlaps, noises due to no-jetting of ink, or curved-shooting of ink are decreased in one line-type head group, and a high quality image can be formed.

When each of line-type heads 411, 412, 421, 422, 431, 432 of line-type head groups 415, 425 and 435 is produced by jointing a plurality of short line-type heads, joints of short line-type heads of each of line-type heads 411, 412, 421, 422, 431, 432 are respectively shifted in the primary scanning direction, thereby, image failure generated by jointing short line-type heads can be prevented.

Further, when, between adjacent nozzles of one line-type head group of line-type heads group 415, 425 and 435, nozzles of the other line-type head groups are located, resolution in the primary scanning direction is improved, and a high quality image can be formed.

Further, even if there is a nozzle defect such as no-jetting of ink or curved-shooting of ink, etc., in any line-type head of line-type heads 411, 412, 421, 422, 431 and 432, and noises are generated in an image, noises are decreased by image formation using other line-type heads, resulting in high quality image.

As described above, when there is any defect on the line-type head, image failure due to nozzle defect can be improved by conducting image formation by using an auxiliary head provided in parallel to the line-type head.

Herein, when a head having image recording width more than that of the line-type head is used as an example of an auxiliary head, image failure can be improved by using the auxiliary head instead of the line-type head, or by driving a nozzle of the auxiliary head corresponding to the defective nozzle of the line-type head.

Particularly, when a nozzle of the auxiliary head is driven corresponding to the defective nozzle of the line-type head, frequency of the replacement of the line-type head is decreased, resulting in a decrease of the replacement cost, and an increase of the reliability.

Further, when, as the auxiliary head, a head movable in the line direction of the line-type head is used, the auxiliary head is moved in such a manner that a nozzle of the auxiliary head is located at a position corresponding to the defective nozzle of the line-type head, the nozzle of the auxiliary head is used instead of the defective nozzle of the line-type head, and an image is formed, thereby, image failure is improved and frequency of replacement of the line-type head is reduced, resulting in a reduction of replacement cost and an increase of the reliability.

Further, in the plurality of image formation conducted on the same recording medium, at least one image formation is conducted by moving the line-type head in the line direction of the line-type head, and image formation of the defective portion is conducted by using other normal nozzles, thereby, image failure due to the defect of the nozzle can be improved.

Further, frequency of replacement of the line-type head is reduced, resulting in a reduction of replacement cost and an increase of the reliability.

A plurality of line-type heads by which liquid drops of ink of the same color are jetted on the recording medium, are provided, thereby, image formation with high image quality or high speed image formation can be attained.

In the primary scanning direction, when, between adjacent nozzles of one line-type head of the plurality of heads, nozzles of the other line-type heads are located, resolution in the primary scanning direction is improved, and a high quality image can be formed.

Further, even if there is a nozzle defect such as no-jetting of ink or curved-shooting of ink, in any line-type heads of a plurality of line-type heads, and noise is generated in an image, the noise is reduced by image formation by using other line-type heads, and high image quality is attained.

When a plurality of line-type heads are located in the direction to cross the primary scanning direction, nozzle pitches in the primary scanning direction are decreased, resolution is increased, and image formation with high quality can be attained.

Further, by providing a plurality of line-type heads, the movement distance of the recording sheet in the subsidiary scanning direction is decreased, and the image forming speed is not lowered.

When each of nozzles of the plurality of line-type heads is located at the same position in the primary scanning direction, a plurality of line images can be simultaneously formed, thereby, high speed image formation can be attained.

Further, when the relative movement in the subsidiary scanning direction of the recording sheet to line-type heads is made into such a movement that a band image obtained by one image formation by a plurality of line-type heads, overlaps, noises due to no-jetting of ink, or curved-shooting of ink are decreased in one line-type head, and a high quality image can be formed.

Still further, in the case where each line-type head is produced by jointing short line-type heads, when joints of small line-type heads of each line-type heads are respectively shifted in the primary scanning direction, image failure generated when short line-type heads are jointed, can be prevented.

In the line-type head group, each nozzle of each line-type head is located at the same position in the primary scanning direction, thereby, a plurality of line images can be simultaneously formed, resulting in high speed image formation.

Yet further, when the relative movement in the subsidiary scanning direction of the recording sheet P to line-type head groups is made into such a movement that a band image obtained by one image formation by a plurality of line-type head groups, overlaps, noises due to no-jetting of ink, or curved-shooting of ink are decreased in one line-type head group, and a high quality image can be formed.

In the case where each line-type head is produced by jointing short line-type heads, when joints of small line-type heads of each line-type heads are respectively shifted in the primary scanning direction, image failure generated when short line-type heads are jointed, can be prevented.

Furthermore, when, between adjacent nozzles of one line-type head group of the plurality of head groups, nozzles of the other line-type head groups are located, resolution in the primary scanning direction is improved, and a high quality image can be formed.

Further, even if there is a nozzle defect such as no-jetting of ink or curved-shooting of ink, in any line-type head of a plurality of line-type heads, and noise is generated in an image, the noise is reduced by image formation by using other line-type heads, and high image quality is attained.

What is claimed is:

1. An-ink-jet printer, comprising:

a printing head to emit ink particles, said printing head being a line-type head in which a plurality of ink-jet nozzles are arranged in a line;

nozzle checking means for detecting a defect in one of said ink-jet nozzles in said printing head; and driving means for moving said printing head in a direction of said line in which said plurality of ink-jet nozzles are arranged, wherein said ink-jet printer utilizes said printing head to perform a plurality of image formation operations onto a same scanning line of said recording medium to form an image of said scanning line when said nozzle checking means detects any said defect in one of said ink-jet nozzles in said printing head, in such a manner that, in at least one image formation operation of said plurality of image formation operations, said driving means moves said printing head in the direction of said line in which said ink-jet nozzles are arranged so as to form said image of said scanning line by using a normal one of said ink-jet nozzles in said printing head instead of a defective one of said ink-jet nozzles detected by said nozzle checking means.

2. The ink-jet printer of claim 1, further comprising:

a drum having a center axis around which said drum is rotatable; and driving means for rotating said drum around said center axis, wherein said drum is adapted to bear a recording medium on a circumferential surface thereof and to convey said recording medium in a subsidiary scanning direction when said drum is rotated by said driving means.

* * * * *